US012130060B1

(12) United States Patent
Sykes et al.

(10) Patent No.: US 12,130,060 B1
(45) Date of Patent: Oct. 29, 2024

(54) THERMAL MANAGEMENT SYSTEM FOR HIGHLY TRANSIENT PULSED HIGH-HEAT-FLUX LOADS

(71) Applicant: Mainstream Engineering Corporation, Rockledge, FL (US)

(72) Inventors: David M. Sykes, Melbourne, FL (US); Jeffrey A. Milkie, Satellite Beach, FL (US); Dana L. Elliot, Rockledge, FL (US); Robert P. Scaringe, Indialantic, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 170 days.

(21) Appl. No.: 17/809,673

(22) Filed: Jun. 29, 2022

(51) Int. Cl.
*F25B 41/20* (2021.01)
*F25B 49/02* (2006.01)

(52) U.S. Cl.
CPC ..... *F25B 41/20* (2021.01); *F25B 49/02* (2013.01); *F25B 2400/0401* (2013.01); *F25B 2400/0409* (2013.01); *F25B 2600/2501* (2013.01); *F25B 2700/2117* (2013.01)

(58) Field of Classification Search
CPC .. F25B 2700/21171; F25B 2700/21173; F25B 41/30; F25B 41/31; F25B 2400/0401; F25B 2400/0409; F25B 2600/2501; F25B 2600/2513
See application file for complete search history.

(56) References Cited

U.S. PATENT DOCUMENTS

| | | | | |
|---|---|---|---|---|
| 10,989,455 | B1 * | 4/2021 | Sykes | F25B 41/325 |
| 2022/0357082 | A1 * | 11/2022 | Unton | F25B 25/005 |
| 2022/0390149 | A1 * | 12/2022 | Vaisman | F25B 41/20 |
| 2022/0404081 | A1 * | 12/2022 | Vaisman | F25B 41/31 |
| 2022/0404105 | A1 * | 12/2022 | Vaisman | F25B 43/043 |
| 2023/0026371 | A1 * | 1/2023 | Swain | F28F 9/0275 |
| 2023/0400283 | A1 * | 12/2023 | Vignali | F25B 49/02 |

* cited by examiner

*Primary Examiner* — David J Teitelbaum
*Assistant Examiner* — Devon Moore
(74) *Attorney, Agent, or Firm* — Michael W. O'Neill, Esq.

(57) ABSTRACT

A vapor compression system control implementations that maintain surface temperature uniformity of at least one cold plate throughout pulsed thermal loads from a minimal or zero load state suddenly to a high or 100% of design capacity state where the heat pulse occurrence, frequency, and durations are not known a priori. Vapor compression system control implementations that maintain surface temperature uniformity of at least one cold plate throughout pulsed thermal loads from a minimal or zero load state suddenly to a high or 100% of design capacity state where the heat pulse occurrence, frequency, and durations are not known a priori. Rapid thermal pulse applications require a robust control strategy of the cold plate assembly to maintain cold plate surface temperature uniformity. In one implementation, a control system for the cold plate assembly that maintains a uniform cold plate temperature given controlled supply and suction conditions is contemplated.

7 Claims, 29 Drawing Sheets

| Setpoint Controlled | Variable | | Idle | Active | | | | Recovery | |
|---|---|---|---|---|---|---|---|---|---|
| | | | IDLE | t = 0 s | t = 5 s | t = 17 s | End | End + 5 s | End + 15 s |
| | **Pulse Heat Dissipation, kW** | | **0** | **3.97** | **3.97** | **3.97** | **3.97 \| 0** | **0** | **0** |
| + | Condenser Pressure | PSIG | 163 | 160 | 162 | 185 | 157 | 151 | 147.7 |
| | Suction line Pressure | PSIG | 36 | 37 | 55 | 45 | 37 | 27 | 32.3 |
| + | Cold Plate Pressure | PSIG | 80.8 | 80.7 | 59.2 | 57.0 | 57.0 | 75.0 | 75.4 |
| | Average Cold Plate Temperature | °C | 24.1 | 23.9 | 25.7 | 24.5 | 24.5 | 22.7 | 23 |
| | Cold Plate Isothermality | °C | 0.5 | 0.4 | 1.9 | 2.4 | 2.3 | 1.4 | 0.9 |
| | Refrigerant Flow | L/min | 0 | 0 | 1.01 | 1.13 | 1.24 | 0.81 | 0 |
| | Hot Gas Bypass Valve Position, % open | | 21.7 | 21.5 | 21.5 | 11.9 | 11 | 13.6 | 14.1 |
| | Liquid Bypass Valve Position, % open | | 26.6 | 33.4 | 33.3 | 0 | 3.8 | 7.4 | 28.4 |
| | Fan Speed, RPM | | 2740 | 2830 | 2910 | 4760 | 4850 | 4920 | 3790 |

FIG. 26

THERMAL MANAGEMENT SYSTEM FOR HIGHLY TRANSIENT PULSED HIGH-HEAT-FLUX LOADS

STATEMENT REGARDING FEDERALLY SPONSORED RESEARCH OR DEVELOPMENT

This invention was made with government support under N00014-15-C-0134 awarded by United States Navy, Office of Naval Research. The government has certain rights in the invention.

BACKGROUND

The following prior art appears material to the invention: U.S. Pat. Nos. 6,883,334, 7,997,092, 6,360,553, 5,867,995, 6,662,583, 3,434,299, 7,992,398, and 8,151,583.

Highly transient pulsed high-heat-flux loads result from the operation of high energy heat generating components such as electronics, laser diodes, or similar, that cycle between an OFF state with low or zero heat generation to an ON state with full heat generation. The generated heat in both the ON and OFF state must be removed while maintaining a uniform temperature of all the heat generating components throughout the cycling. During operation, the heat pulse occurrence, frequency, and durations are not known by the cooling system a priori. A refrigerant-cooled cold plate assembly for pulsed high flux heat load applications requires a highly uniform temperature, near isothermal temperature distribution across the entire heat transfer surface of the cold plate during the entire operational duty cycle (both during the heat load pulse and the off portion of the operational cycle). This isothermal heat transfer surface temperature is necessary to assure proper operation or extended life of the components being cooled.

In a direct vapor compression system for pulse heat load applications a refrigerant-cooled cold plate assembly serves as the evaporator. Subcooled liquid, saturated liquid, or nearly saturated two-phase refrigerant enters the cold plate assembly, accepts heat from the cold plate by removing heat from the heat generating components, and this heat evaporates the refrigerant and can superheat the refrigerant. With proper control, the refrigerant should exit the cold plate assembly as a near saturated vapor or as a slightly superheated vapor state. As the cold plate is heated by the pulsed thermal loads, the temperature difference between the cold plate and the fluid increases. As the pulsed heat load applied to the cold plate surface cycles between zero and 100% power, the temperature difference between the refrigerant inside the cold plate and the cold plate surface fluctuates widely, and without precise control the temperature of the electronics being cooled, that is the temperature of the heat generating components would also fluctuate widely, which is unacceptable in most applications. Thus, the system must be ready to provide additional cooling at the instant of the first pulse, and subsequently, modulate the cooling effect and fluid temperature during the cycling pulses so as to not over or under cool the cold plate, and maintain temperature stability throughout the heat pulses. The difficulty of maintaining near isothermal electronic temperatures given this operational scenario, with zero to 100% variation of a very high heat load, cannot be overstated.

The prior art control methods are lacking in key areas required for cold plate surface temperature uniformity in pulsed heat load applications. First, the prior art lacks vapor compression system cold plate supply and return process stream stability under cycling cold plate thermal loads which can vary between 0% to 100% of full-load. Also, the vapor-compression system must reject this cold plate heat load to a potentially highly variable outdoor ambient temperature, without significantly affecting the cold plate isothermal temperature distribution. Finally, the prior art lacks any local integrated cold plate controls to maintain surface temperature under cycling heat loads from 0% to 100%. It is important to understand that nothing in the prior art is capable of maintaining an isothermal cold plate temperature distribution during all possible highly variable operational conditions and varying outdoor ambient conditioners without any prior knowledge of the heat pulse occurrence, frequency, and duration.

Prior art vapor compression system control methods are not designed and are insufficient to maintain cold plate surface temperature uniformity through highly variable pulsed heat loads or even with highly variable ambient temperatures. Most prior art control methods are designed for air-coupled systems, such as air conditioning systems, refrigerators and freezers including large commercial installations, or similar. The air-coupled systems are designed to maintain the air within a temperature band and often rely on air temperature measurements for control feedback. These systems are operated in a cyclical manner where the temperature of the air reaches an upper temperature limit set point. The vapor compression system turns on to provide cooling until the air reaches the minimum temperature set point at which time the system turns off until the temperature reaches the upper temperature limit set point again. This mode of operation (thermostatic control) is insufficient to supply cold plate surface temperatures under pulsed heat loads.

Additionally, these systems are either on or off. While in the off state, the system is incapable of providing the required cooling and control. Attempts to modulate evaporator capacity are mainly focused on small capacity changes for system efficiency, not high turndown conditions. Thus, these prior art control methods lack evaporator process condition stability and maintaining stability through the transition to 100%.

Recently, with the advent of variable speed drives for compressors, another popular prior art vapor compression system control method has emerged, where the compressor speed and thus the compressor output and cooling capacity is varied to match the average heat load demand at a particular time. Since the compressor speed has to be changed to change heat removal rates and due to the thermal inertia of the system and the dynamic inertia of the compressor, the response time of such a system is far too slow to maintain the necessary isothermal cold plate temperatures required for the highly transient cold plate thermal loads discussed in this disclosure. Once again, like the other vapor compression control methods discussed as prior art, the variable speed compressor control method is also designed for air-coupled systems, such as air conditioning systems, refrigerators and freezers including large commercial installations, or similar. Even when utilizing the variable compressor speed control, these air-coupled systems are still designed to maintain the air within a temperature band, however, the variable speed compressor modulations, typically results in longer cyclical operations, meaning when the air reaches an upper temperature limit set point and the he vapor compression system turns on it will operate for a longer period of time, before cycling off, since the supply of cooling is more closely matched to the demand for heat removal.

Many prior art vapor compression system and evaporator control methods rely on one or more temperature sensors to provide feedback for control of the evaporator conditions. Temperature feedback control methods are insufficient to maintain cold plate surface temperature uniformity due to temperature sensor uncertainties and hysteresis, cold plate and system-level thermal inertia which delay the temperature sensor response, dynamic inertial of the compressor, fluid inertial of the refrigerant in the plumbing, and system component response times. Due to the precise cold plate surface temperature uniformity requirements, these factors prevent temperature measurements from being able to maintain cold plate surface temperature uniformity through pulsed heat loads.

Similarly, there is insufficient time for the vapor compression system to start, or even change operating speed, following a heat pulse. Precise control of the cold plate surface temperature uniformity through pulsed heating requires precise control of the vapor compression system. Prior art control methods allow the evaporator pressure (and corresponding temperature) to fluctuate as the system stabilizes. The heat load pulsing introduces an instability at the start of each pulse, precisely at the time when temperature uniformity is of greatest importance.

Information relevant to attempts to address these problems can be found in U.S. Pat. Nos. 6,883,334 and 7,997,092. However, each one of these references suffers from one or more of the following disadvantages: unable to maintain system stability through heat pulses, relies on evaporator temperature feedback for control (which is too slow for highly transient conditions), and unable to maintain uniform cold plate temperatures.

For the foregoing reasons, there is a need for vapor compression system control implementations that maintain surface temperature uniformity of at least one cold plate throughout pulsed thermal loads from a minimal or zero load state suddenly to a high or 100% of design capacity state where the heat pulse occurrence, frequency, and durations are not known a priori. This requires implementations for control of vapor compression systems in highly transient pulsed heat load systems capable of providing controlled refrigerant supply and return process conditions to a cold plate assembly without prior knowledge of the upcoming heat load requirements.

SUMMARY

The present disclosure describes the implementations of control for a vapor compression systems and a cold plate assemblies for providing cooling and uniform temperature control of one or more cold plates with at least one heat generating device. As used in this disclosure, a cold plate is a device with at least one heat generating unit attached to its surface, along with passages to permit cooling fluid, such as refrigerant, to absorb the heat from the heat generating device and the flow of the fluid to remove the heat from the cold plate. In one implementation, a cold plate assembly includes the cold plate and the associated control valves, fluid conduits, and heat exchangers that is necessary for cold plate surface temperature control. At least one implementation is concerned with the control of the vapor compression system(s), expansion valve(s), electronically-actuated valve(s), and electronic pressure regulator(s) to maintain a uniform cold plate surface temperature through pulsed heat loads.

For cold plate cooling applications, the vapor compression system compressor must be able to operate at near 100% capacity between zero and 100% design thermal load. In addition to the wide operating range, the vapor compression supply and suction conditions must remain controllable through the heat load transitions. A control system that is capable of maintaining stable vapor compression system operation that provides controlled refrigerant supply and suction conditions to the cold plate assembly when the compressor is operating at full capacity, is required.

Rapid thermal pulse applications require a robust control strategy of the cold plate assembly to maintain cold plate surface temperature uniformity. In one implementation, a control system for the cold plate assembly that maintains a uniform cold plate temperature given controlled supply and suction conditions is contemplated. In one implementation, the cold plate assembly includes at least one cold plate, at least one control valve(s), at least one recuperator, and at least one electronic pressure regulator(s), and may also include at least one orifice plate. Another implementation is a control system for a vapor compression system that provides controlled supply and suction conditions to at least one cold plate assembly or other pulsed thermal load application. All implementations are independent but can implemented together to maintain cold plate surface temperature uniformity through a range of thermal load profiles.

With controlled supply and suction return conditions at least one implementation has been validated to maintain cold plate surface temperature uniformity throughout significant transient conditions including no-load idle states, high-frequency pulsed thermal loads, low-frequency pulsed thermal loads, random-pulsed thermal loads, and continuous thermal loads. One implementation requires no a priori knowledge of the occurrence a thermal load event or pulse pattern during thermal load event.

Uniform cold plate surface temperature controls require the vapor compression system to provide controlled supply and suction conditions during the idle condition with no heat load, through the heat pulses, and back to the idle mode. We have validated the vapor compression system control implementations that promotes dynamic stability of the refrigerant liquid supply thermodynamic conditions (enthalpy and pressure) and suction vapor thermodynamic conditions (enthalpy and pressure). With these conditions, the cold plate control implementations were capable of maintaining cold plate surface temperature uniformity throughout a wide range of operating modes. For convenience only, supply conditions and suction conditions will be used to refer to the thermodynamic and process conditions identified above.

It is an object of the disclosure to implement a process of maintaining a uniform isothermal temperature distribution on at least one cold plate having highly transient thermal loads thereon by utilizing a vapor compression apparatus having a supply line and a return line connected to the cold plate and using a compressor to draw a vapor working fluid from the at least one cold plate in order to compress the vapor working fluid and supply a compressed higher-pressure refrigerant to a condenser and the condenser to condense the working fluid to a liquid that flows to the at least one cold plate and evaporates in the at least one cold plate to remove the heat load supplied to the at least one cold plate from the highly transient thermal loads, and returning a lower-pressure fluid vapor to the inlet of the compressor, where the method comprises: a) adjusting the bypass of fluid flow directly back to the compressor or adjusting the speed of the compressor to maintain a necessary flow rate of fluid to the condenser; b) adjusting the bypass of fluid flow around the at least one cold plate to control the heat removal capacity of the cold plate; c) adjusting the flow of fluid through the at least one cold plate to maintain a desired superheat of fluid exiting the at least one cold plate; and d) adjusting the opening of a valve in the at least one cold plate exit flow path to maintain a desired saturation temperature in the at least one cold plate by adjusting pressure of the fluid in the exit flow path by controlling the opening of the valve in the at least one cold plate discharge flow path.

It is a further object of the disclosure to implement the process of adjusting the temperature of the at least one cold plate is the partial or complete opening and closing of the valve at the discharge of the cold plate, wherein increasing the opening of the valve at the discharge of the cold plate lowers the discharge pressure and lowers the saturation temperature and decreasing the opening of the valve at the discharge of the cold plate increases the saturation temperature.

It is a further object of the disclosure to implement the process of maintaining the desired superheat of the fluid leaving the at least one cold plate is through the adjustment of superheat temperature by at least one of a partial and a complete opening and closing of an expansion valve at the inlet to the one or more cold plates, wherein increasing the opening of the expansion valve reduces the superheat and reducing the opening of the valve increases the superheat.

It is a further object of the disclosure to implement the process of maintaining the desired superheat of the fluid leaving the at least one cold plate is through the adjustment of the superheat temperature by at least one of the partial and complete opening and closing of a thermal or electronic expansion valve.

It is a further object of the disclosure to implement the process of adjusting the flow of fluid through the at least one cold plate with multiple parallel passages is to maintain balanced flow rate among the multiple parallel passages and also maintain the desired superheat of a fluid leaving the multiple parallel passages after being recombined into a single flow from the cold plate exit is through the adjustment of the superheat temperature by at least one of a partial and a complete opening and closing of a single expansion valve at the inlet to all the passages of a cold plate, where each passage has a additional flow restriction or orifice to further drop the pressure, such that the combined pressure drop of the flow restriction and expansion valve is to cause a superheated refrigerant to exit the cold plate, wherein increasing the opening of the valve, reduces the superheat and reducing the opening of the valve increases the superheat.

It is a further object of the disclosure to implement the process of providing a thermal storage device in the refrigerant flow path, either before or after the condenser in the flow path, to increase short-term capacity of the system.

It is a further object of the disclosure to implement the process of providing a liquid receiver in the refrigerant flow path, after the condenser and before the at least one cold plate in the flow path, to increase short-term capacity of the system.

It is a further object of the disclosure to implement the process of providing a suction line accumulator in the refrigerant flow path, before the compressor in the flow path, to protect the compressor during rapid transients.

It is a further object of the disclosure to implement the process of providing thermal control by adjusting the cooling capability of at least one of one or more evaporative heat transfer devices in a vapor compression cooling system, using a condenser cooled by the air flow created by a fan or blower and incorporating at least two bypass plumbing flow paths, the first bypass from compressor discharge returning flow back to the compressor inlet, the second bypass creating a flow that is parallel to the one or more evaporative heat transfer devices, wherein the flow through the first and second bypass circuits is controlled by the opening and closing of valves located in the bypass plumbing circuits and introducing valves at the inlet and outlet of each of the one or more evaporative heat transfer devices and adjusting the position of the inlet valve to control the superheat of fluid exiting the evaporative heat transfer device to the desired value and adjusting the position of the outlet valve to control the evaporating temperature of the evaporative heat transfer device to the desired value.

It is a further object of the disclosure to implement the process of wherein one or more of the heat transfer devices is a cold plate and the valve at the outlet of the one or more cold plates, either one valve for multiple cold plates or multiple valves for multiple cold plates, is adjusted to control the evaporating temperature of the fluid that is evaporating in the cold plate.

It is a further object of the disclosure to implement the process of opening the valve at the outlet of the one or more cold plate reduces the pressure in the one or more cold plates in that flow path and thereby reduces the evaporating temperature of the fluid in the one or more cold plate in that flow path and closing this valve increases the evaporating temperature.

It is a further object of the disclosure to implement that when the heat flux applied to the cold plate increases, thereby increasing the temperature difference between the surface temperature and the saturation temperature of the evaporating refrigerant flowing through the cold plate, whereby the valve at the outlet of the cold plate is further opened to further reduce the saturation temperature of the refrigerant flowing through the cold plate, to accommodate the increased temperature difference between the surface It is a further object of the disclosure to implement that wherein one or more of the heat transfer devices is a cold plate and where the valve at the inlet of the one or more cold plates, either one valve for multiple cold plates or multiple valves for multiple cold plates, is adjusted to control the superheat of the fluid that is returning to the compressor.

It is a further object of the disclosure to implement that wherein the superheat being controlled is sensed at one of the outlet of the heat transfer device, the outlet of a recuperative heat exchanger located between the heat transfer device and the compressor inlet, and the compressor inlet.

It is a further object of the disclosure to implement that wherein opening one or more valves at the inlet of the one or more cold plate reduces superheat and closing this valve increases superheat.

It is a further object of the disclosure to implement that wherein opening the valve in the bypass allowing compressor discharge to return to the compressor inlet reduces the flow rate of fluid being sent to the condenser and thereby reduces total cooling capacity and closing this valve increases the flow rate of fluid being sent to the condenser and increases total cooling capacity.

It is a further object of the disclosure to implement that wherein reducing the air flow provided by the fan or blower reduces the heat rejection by the condenser and reduces total cooling capacity and increasing the air flow provided by the fan or blower increases the heat rejection by the condenser and increases cooling capacity.

It is a further object of the disclosure to implement that wherein opening the valve in the bypass around the one or more cold plates reduces the cooling capacity of the one or more cold plates being bypassed and closing this valve increases the cooling capacity of the one or more cold plates being bypassed.

It is a further object of the disclosure to implement that wherein opening the bypass valves and cold plate inlet and outlet valves are adjusted simultaneously.

It is a further object of the disclosure to implement that wherein opening the bypass valves and cold plate inlet and outlet valves are adjusted sequentially.

It is a further object of the disclosure to implement that wherein sequential order of adjustment of the valves is to adjust the one or more cold plate outlet valves first, then the cold plate liquid bypass valve, then compressor bypass valve while the one or more cold plate inlet valves are continuously adjusted to control cold plate saturation temperature, cold plate cooling capacity, and superheat in the return stream to the compressor.

It is a further object of the disclosure to implement that wherein sequential order of adjustment of the valves is to adjust the compressor bypass valve and cold plate bypass valve first and then adjust the one or more cold plate outlet valves, while the one or more cold plate inlet valves are continuously adjusted to control cold plate saturation temperature, cold plate cooling capacity, and superheat in the return stream to the compressor.

It is a further object of the disclosure to implement that wherein reducing the speed of the compressor reduces the flow rate of fluid being sent to the condenser and thereby reduces total cooling capacity and increasing the speed of the compressor increases the flow rate of fluid being sent to the condenser and thereby increases total cooling capacity.

It is a further object of the disclosure to implement a method of providing thermal control by adjusting the cooling capability of one or more evaporative cold-plates in a vapor compression cooling system, using a condenser cooled by the air flow created by a fan or blower or cooled by the pumping of a coolant through the condenser, using one or more compressors capable of operating a variable speeds, and introducing a valve at the inlet and outlet of the one or more cold plates and adjusting the positions of these valves and the speed of the one or more compressors and the speed of the fan, blower or pump to change the cooling to the condenser, to maintain uniformity of the cold plate surface temperature, and to control this surface temperature to the desired value.

It is a further object of the disclosure to implement that wherein changing the cooling to the condenser, changing the speed of the compressor and adjusting cold plate inlet and outlet valves are all performed simultaneously.

It is a further object of the disclosure to implement that wherein changing the cooling to the condenser, changing the speed of the compressor and adjusting cold plate inlet and outlet valves are all performed sequentially.

It is a further object of the disclosure to implement that wherein the sequential order of adjustment of the control parameters is to adjust the compressor speed first, then adjust the condenser cooling, followed by adjustment of the one or more cold plate outlet valves while the cold plate inlet valve is continuously adjusted to control the superheat of the refrigerant flow back to the compressor.

It is a further object of the disclosure to implement that wherein order of adjustment of the control parameters is to adjust the compressor speed first and condenser cooling first, followed by adjustment of the one or more cold plate outlet valves while the cold plate inlet valve is continuously adjusted to control the superheat of the refrigerant flow back to the compressor.

It is a further object of the disclosure to implement a method of maintaining an isothermal temperature distribution on one or more cold plates when prior knowledge of a highly transient thermal loads will be applied to one or more expansion valve controlled evaporative cold plates in a vapor compression cooling system by using a rapidly opening valve plumbed in parallel to the expansion valve and supplying additional fluid to the evaporative cold plate experiencing the highly transient load by temporally opening this rapidly opening valve, when the highly transient load is applied, to provide the time for the expansion valve to react and then closing this rapidly opening valve.

It is a further object of the disclosure to implement a method of providing thermal control by adjusting the cooling capability of one or more evaporative cold-plates in a vapor compression cooling system, by introducing a compressor bypass path from the compressor discharge to the compressor suction, where the flow in this flow path is controlled by the position of a valve located in this flow path, an evaporative heat transfer device bypass path from the condenser outlet to the compressor suction, where the flow in this flow path is controlled by the position of a valve located in this flow path, a valve at the inlet and outlet of the one or more cold plates and adjusting the positions of these valves to provide compressor inlet conditions of pressure and temperature to avoid compressor damage, maintain uniformity of the cold plate surface temperature, and to control this surface temperature to the desired value, where the first step is to simultaneous adjust the flow of refrigerant being returned to the compressor inlet directly from the compressor outlet, depending on the position of a valve in the plumbing circuit connecting the compressor discharge with the compressor inlet, to achieve the desired compressor suction pressure, while also adjusting the flow of refrigerant being returned to the compressor inlet directly from the condenser outlet, depending on the position of a valve in the plumbing circuit connecting the condenser outlet with the compressor inlet, to provide any necessary cooling of the compressor inlet stream to adjust the superheat of the compressor inlet stream, to maintain the compressor inlet conditions within acceptable operating pressure and temperature conditions, then adjusting the cold plate outlet valves to set the cold plate evaporating temperature, where the cold plate inlet valve(s) serves as expansion valve(s) that are continually adjusted to maintain a superheat refrigerant at the cold plate outlet.

It is a further object of the disclosure to implement a method of providing thermal control by adjusting the cooling capability of one or more evaporative cold-plates in a vapor compression cooling system, using a condenser cooled by the air flow created by a fan or blower or cooled by the pumping of a coolant through the condenser, and introducing a valve at the inlet and outlet of the one or more cold plates and adjusting the positions of these valves and the speed of the fan, blower or pump to change the cooling to the condenser, to maintain uniformity of the cold plate surface temperature, and to control this surface temperature to the desired value, where the first step is to adjust the speed of the fan, blower or pump and then to simultaneous adjust the flow of refrigerant being returned to the compressor inlet directly from the compressor outlet, depending on the position of a valve in the plumbing circuit connecting the compressor discharge with the compressor inlet, to achieve the desired compressor suction pressure, while also adjusting the flow of refrigerant being returned to the compressor inlet directly from the condenser outlet, depending on the position of a valve in the plumbing circuit connecting the condenser outlet with the compressor inlet, to provide any necessary cooling of the compressor inlet stream to adjust the superheat of the compressor inlet stream, to maintain the compressor inlet conditions within acceptable operating pressure and temperature conditions, then adjusting the cold plate outlet valves to set the cold plate evaporating temperature, where the cold plate inlet valve(s) serves as expansion valve(s) that are continually adjusted to maintain a superheat refrigerant at the cold plate outlet.

It is a further object of the disclosure to implement a method of providing thermal control by adjusting the cooling capability of one or more evaporative cold-plates in a vapor compression cooling system, using a condenser cooled by the air flow created by a fan or blower or cooled by the pumping of a coolant through the condenser, using one or more compressors capable of operating a variable speeds, and introducing a valve at the inlet and outlet of the one or more cold plates and adjusting the positions of these valves and the speed of the one or more compressors and the speed of the fan, blower or pump to change the cooling to the condenser, to maintain uniformity of the cold plate surface temperature, and to control this surface temperature to the desired value, where the first step is to adjust the speed of the one or more compressors to best approach the desired pressure ratio of the compressor, the next step is to adjust the speed of the fan, blower or pump removing heat from the condenser, where increasing the speed increases the heat removed from the condenser, and then to simultaneous adjust the flow of refrigerant being returned to the compressor inlet directly from the compressor outlet, depending on the position of a valve in the plumbing circuit connecting the compressor discharge with the compressor inlet, to achieve the desired compressor suction pressure, while also adjusting the flow of refrigerant being returned to the compressor inlet directly from the condenser outlet, depending on the position of a valve in the plumbing circuit connecting the condenser outlet with the compressor inlet, to provide any necessary cooling of the compressor inlet stream to adjust the superheat of the compressor inlet stream, to maintain the compressor inlet conditions within acceptable operating pressure and temperature conditions, then adjusting the cold plate outlet valves to set the cold plate evaporating temperature, where the cold plate inlet valve(s) serves as expansion valve(s) that are continually adjusted to maintain a superheat refrigerant at the cold plate outlet.

It is a further object of the disclosure to implement a method of providing thermal control by adjusting the cooling capability of one or more evaporative cold-plates in a vapor compression cooling system, where the flow into the cold-plate is controlled by two or more parallel flow paths, where the flow in at least one flow path is controlled by a expansion valve, that is adjusted to maintain a determined superheat at the exit of the cold plate or returning to the compressor, and at least one flow path has an electrically actuated valve that can be opened and closed upon the command of the controller, and the one or more electronically actuated valves are pulsed open and then closed in a predetermined timed sequence of one or more valve open/close intervals to allow refrigerant to flood the cold plate to achieved a desired cold plate surface temperature either when no thermal load or a spike in thermal load is applied to the cold plate.

It is a further object of the disclosure to implement that wherein the time interval that the electronically actuated valve is opened, and maintained opened, is determined to be between 0.3 and 3 times the average liquid transit time through the cold plate.

It is a further object of the disclosure to implement that wherein the time interval when the electronically actuated valve is closed, and maintained closed, is between 10 to 200 times the valve open duration.

In one implementation, a vapor compression apparatus having a saturated or subcooled liquid supply line to a heat load application for cooling the heat load application and a saturated or superheated refrigerant return line connected from the heat load application in order to circulate a refrigerant, comprising: a compressor to compress the refrigerant and having a suction line inlet to receive saturated or superheated refrigerant in the return line from the heat load application and a discharge outlet; a condenser to condense the refrigerant coming from the compressor discharge outlet and a liquid outlet which provides the saturated or subcooled liquid supply to the heat load application; a hot-gas bypass line with an in-line control valve, where the bypass line is attached between the compressor discharge outlet of the compressor and the suction inlet line of the compressor and; a liquid bypass line with an in-line valve, where the bypass line is attached between the outlet of the condenser and the suction inlet of the compressor.

In a further implementation, the control valve in the hot-gas bypass is adjusted to regulate refrigerant flow to the condenser.

In a further implementation, the control valve in the hot-gas bypass is an electrically actuated solenoid valve that cycles open and closed to regulate refrigerant flow to the condenser.

In a further implementation, the control valve in the hot-gas bypass is adjusted to increase the superheat of the mixture of the saturated refrigerant returning from the heat load device and the hot-gas bypass flow, to assure that the refrigerant entering the compressor suction line inlet is a vapor, to avoid compressor damage.

In a further implementation, the control valve in the liquid bypass is adjusted to regulate refrigerant flow to the heat load application.

In a further implementation, the control valve in the liquid bypass is adjusted to decrease the superheat of the mixture of the saturated refrigerant returning from the heat load device and the liquid bypass flow, to assure that the refrigerant entering the compressor suction line inlet is not too hot, to avoid compressor damage.

In a further implementation, the control valve in the liquid bypass is adjusted to provide a flow of condensed refrigerant to the inlet of the compressor to cool the compressor.

In a further implementation, the control valve in the liquid bypass is an electrically actuated solenoid valve which is cycled open and closed to regulate refrigerant flow diverted back to the compressor inlet.

In a further implementation, a thermal energy storage device to cool the refrigerant and is positioned between the condenser outlet and the heat load application.

In a further implementation, the thermal energy storage device serves to increase the subcooling of the refrigerant in the liquid supply line to the heat load application.

In a further implementation, a thermal energy storage device to cool the refrigerant and is positioned between the compressor outlet and the condenser inlet.

In a further implementation, the thermal energy storage device serves to reduce the condenser cooling load.

In another implementation there is a cold plate assembly that is capable of being connected to a supply side and a return side of a vapor compression apparatus using a refrigerant, comprising: at least one cold plate with at least one refrigerant passage, a cold plate surface, and at least one heat generating device mounted on the cold plate surface; at least two parallel flow valve assemblies, to create at least two parallel flow paths that connect the supply side refrigerant flow to the at least one cold plate; a sensor connected to at least one of the valve assemblies and the sensor controls the increase or decrease of flow through that flow path to maintain a desired superheat of the refrigerant exiting the cold plate assembly and returning to the return side of the vapor compression apparatus; and an electrically activated valve in at least one of the remaining parallel flow valve assemblies, that can be partially or completely opened or closed to increase or decrease flow through that flow path to maintain a desired surface temperature of the cold plate when no heat load is applied to the cold plate or when a sudden change in heat load applied to the cold plate occurs.

In a further implementation, an optional recuperator that has at least two passages, at least one for the flow of refrigerant from the supply side to the inlet of the cold plate and at least one for the flow of refrigerant from the return side of the cold plate to the return side of the direct vapor compression apparatus.

In a further implementation, a pressure regulating valve connected to the return side of the assembly, so that refrigerant must flow through this valve before flowing to the return side of a direct vapor compression apparatus.

In a further implementation, the pressure regulating valve is adjusted to change the pressure of the saturated refrigerant flowing in the cold plate passage and thereby change the saturation temperature in the cold plate passage.

In a further implementation, the pressure regulating valve is an electrically actuated valve.

In a further implementation, the at least one cold plate passage has an orifice at the inlet of the passage for refrigerant flow control.

In a further implementation, the cold plate module further comprises: a cover plate having an inlet, a plurality of microchannel partial passages and one outlet; and a base plate having a plurality of microchannel partial passaged aligned with the plurality of partial passages in the cover plate to form a plurality of complete microchannel passages extending through the cover/base plate assembly to separate any refrigerant passing through the cold plate into a plurality of individual streams in order to direct precise cooling to exact locations on the cover plate, and base plate and the cover plate and base plate are bonded to seal the plurality of microchannels in order to contain the refrigerant within the cold plate module.

In another implementation there is an apparatus to maintain at least one cold plate surface at nearly an isothermal state during at least one of a heat flux pulse, rapid heat addition transients, and heat pulse event, comprising at least one evaporative cold plate cooled by the evaporation of refrigerant as part of a vapor-compression thermal control system, which contains inlet and outlet valves on the one or more cold plates, a hot gas bypass circuit controlled by a first valve, to direct compressor discharge vapor back to the compressor inlet, and a liquid bypass circuit controlled by a second valve to direct condenser outlet refrigerant back to the compressor inlet, where as all the valves are adjusted to maintain a desired cold plate surface temperature.

In a further implementation, all the valves are operated simultaneously to control the cold plate surface temperature.

In a further implementation, the order of adjusting the valves is to adjust the one or more cold plate outlet valves first, then adjust the one or more cold plate liquid bypass valves, then adjust the compressor bypass valve while the one or more cold plate inlet valves are continuously adjusted to control cold plate exit superheat.

In a further implementation, the order of adjusting the valves is to adjust the compressor hot gas bypass valve and the one or more cold plate liquid bypass valves together to control compressor inlet conditions and then adjust the one or more cold plate outlet valves, to adjust evaporator saturation temperature, while the one or more cold plate inlet valves are continuously adjusted to control cold plate exit superheat.

In another implementation, there is an apparatus to maintain a cold plate surface at nearly an isothermal state during at least one of a heat flux pulse, a rapid heat addition transients, and pulse event, comprising: a controller that monitors at least one of a pulse event trigger, a power draw of heat generating components, a cold plate state (enabled/disabled), and system specific parameter indicating an operating mode, state, or condition.

The present disclosure improves on the known variations of vapor compression systems and cold plates for high-flux pulsed heat load applications by providing implementations for control of both systems, independent or together, capable of maintaining uniform temperatures of the cold plate surface-mounted heat generating components operating under pulsed heat loads.

BRIEF DESCRIPTION OF THE DRAWINGS

These and other features, aspects, and advantages of the present invention will become better understood with regard to the following description, appended claims, and accompanying drawings where:

FIG. 26 shows a summary of key operating parameters of a demonstration system at multiple times.

DESCRIPTION

In the Summary above and the Description, and the Claims below, and in the accompany drawings, reference is made to particular features (including method steps) of the invention. It is to be understood that the disclosure of the implementations in this specification includes all possible combinations of such particular features. For example, where a particular aspect or embodiment of the invention, or a particular claim, that feature can also be used, to the extent possible, in combination with and/or in the context of the other particular aspects and embodiments of the invention, and in the invention generally.

Figure 1A:
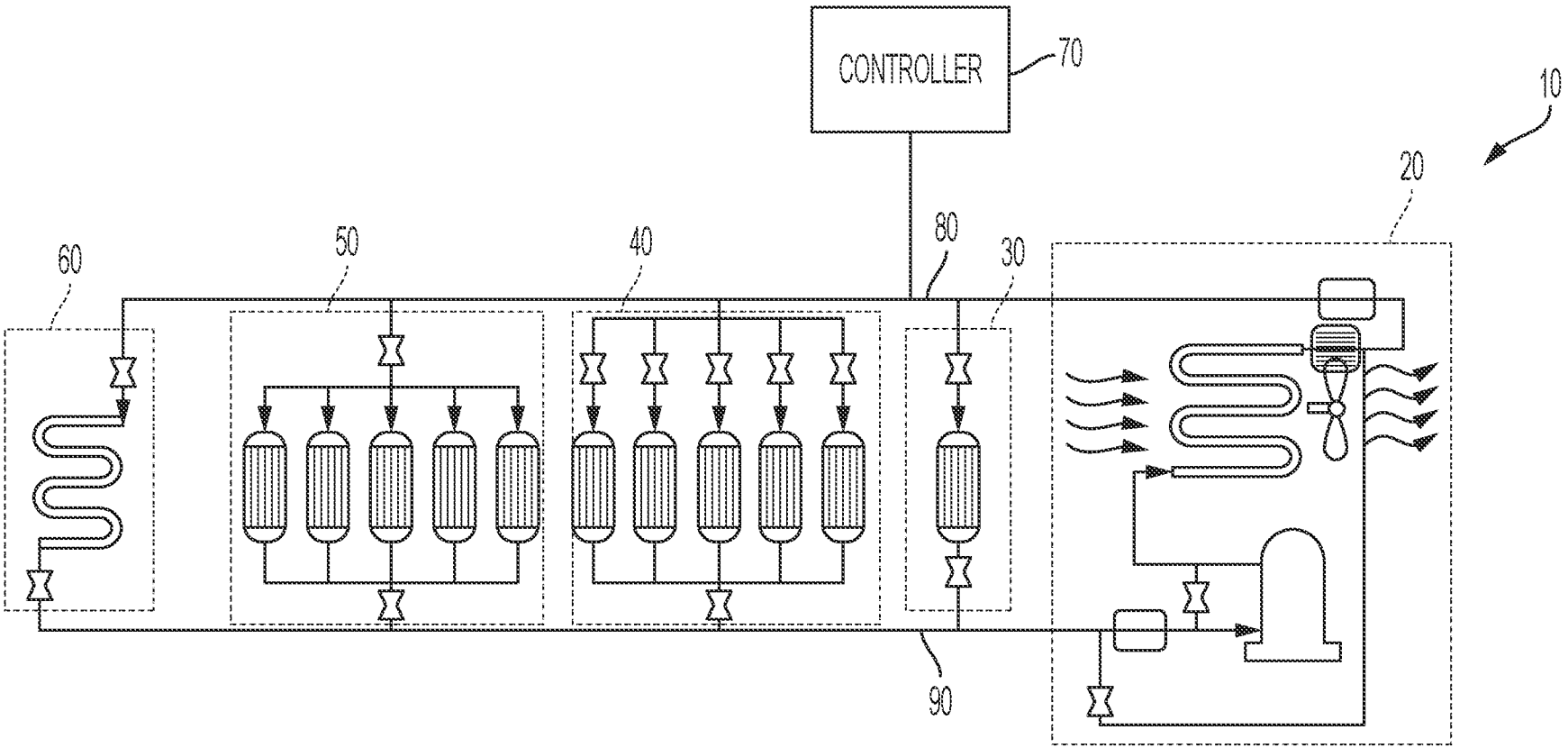
FIG. 1A shows a schematic view of the complete system.
Figure 1B:
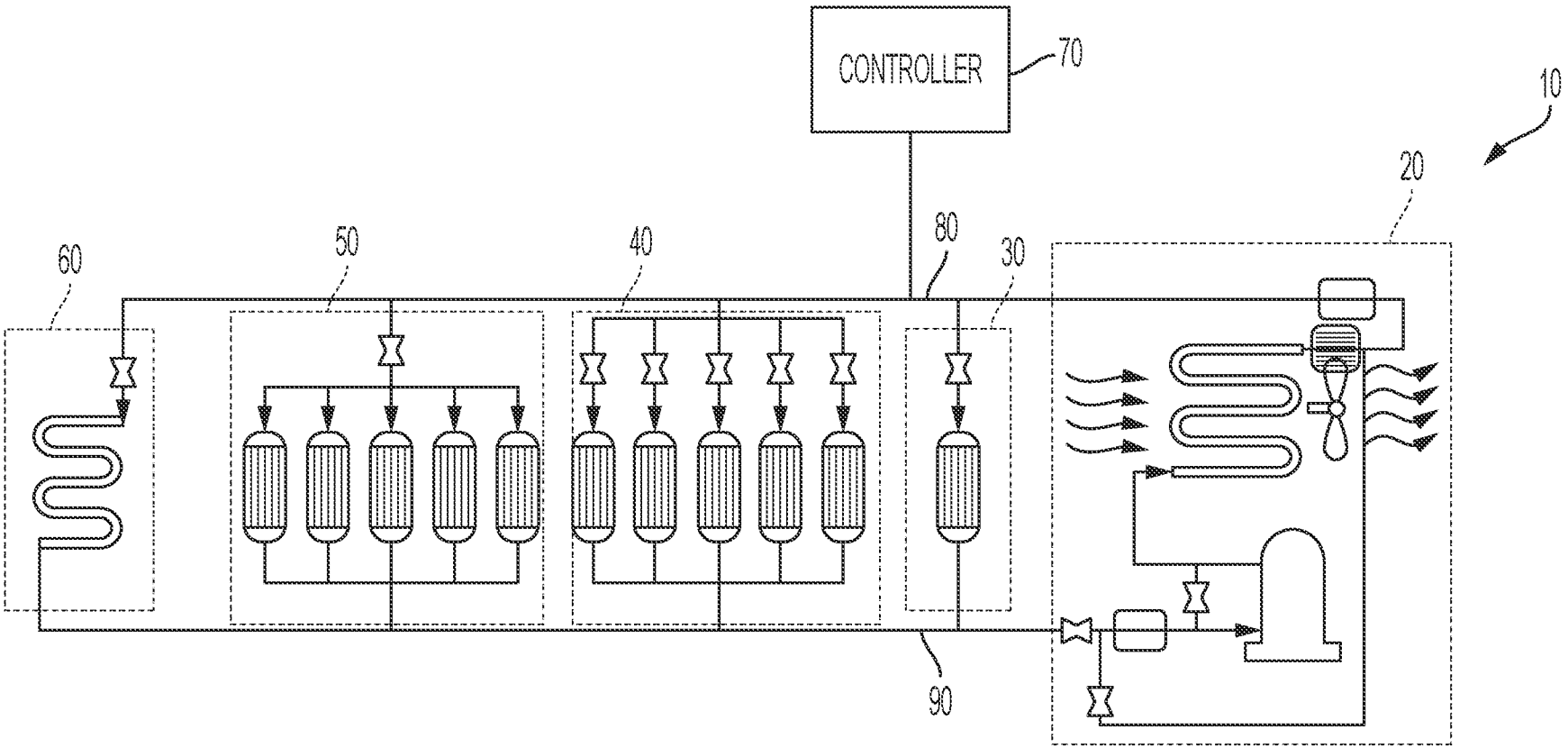
FIG. 1B shows an alternative schematic view of the complete system.

Referring to FIGS. 1A and 1B, one implementation controls a system (10) having a direct vapor compression system (20) and at least one cold plate assembly. The cold plate assembly can be configured as an individual cold plate assembly (30), as a group of cold plate assemblies of type I (40), and/or as a group of cold plate assemblies of type II (50). In this context. a cold plate assembly of type I is constructed such that the control components (i.e. control valve(s), at least one recuperator, and at least one electronic pressure regulator(s)) are physically attached and dedicate to each cold plate. A cold plate assembly of type II is constructed such that only one set of control components (i.e., control valve(s), at least one recuperator, and at least one electronic pressure regulator(s)) are used for an array of cold plates. The system may also contain at least one optional evaporator (60) that is not maintained isothermal and may consist of space conditioning, liquid-coupled, or similar. The direct vapor compression system (20) supplies refrigerant to and receives refrigerant from the cold plate assemblies (30), (40), (50), and/or evaporator (60) via a liquid supply (80) and vapor return (90). The entire system is controlled with an electronic controller (70) which may be a central controller or distributed controller (not shown) with control components in the central vapor compression system (20) and the cold plate assemblies (30), (40), and/or (50). Distributed controllers can but do not necessarily have to be connected to other control units.

Figure 2:
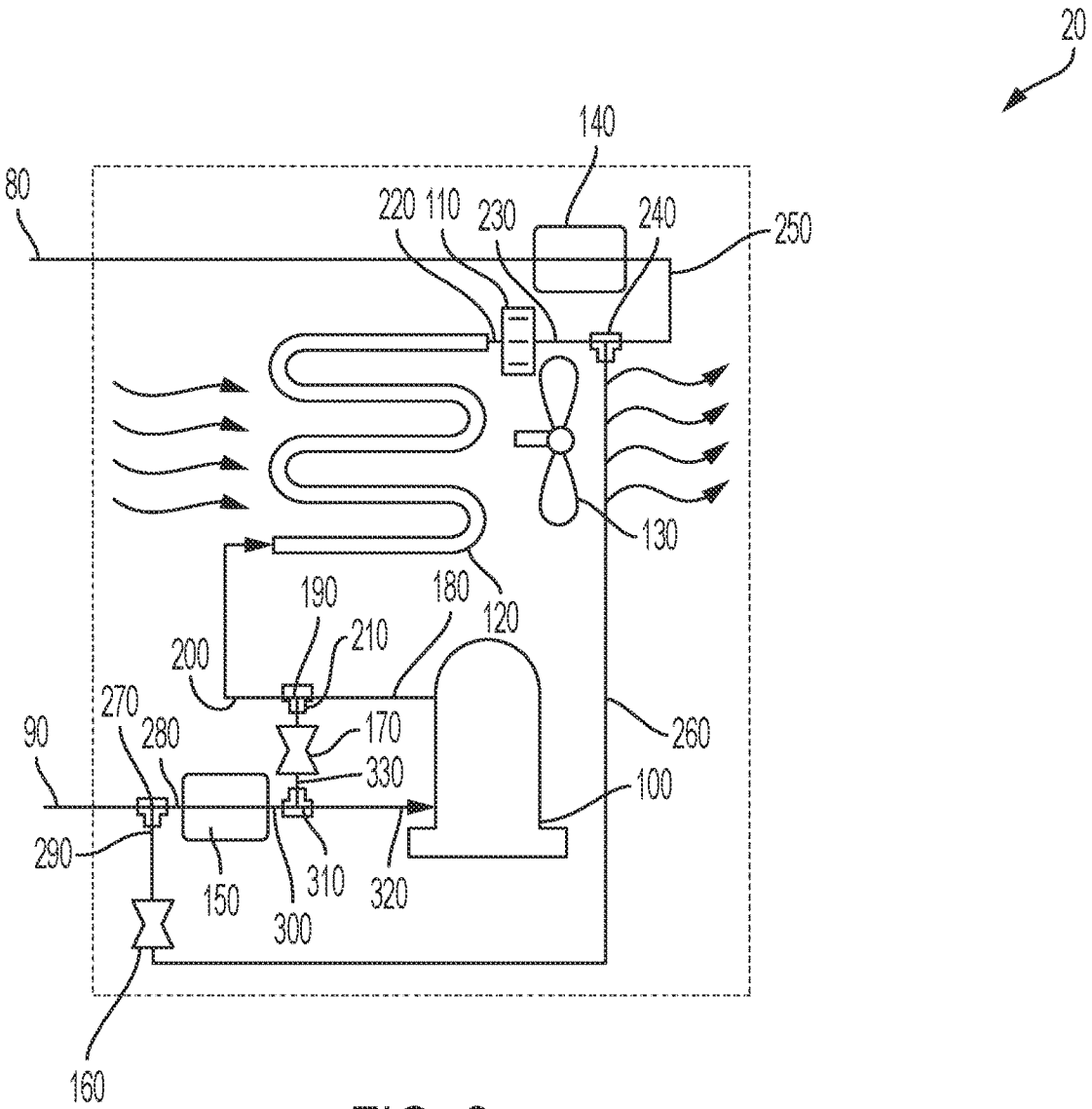
FIG. 2 shows a schematic view of vapor compression system module.

Referring to FIG. 2, in at least one implementation, the direct vapor compression system (20) includes a compressor (100), a condenser (120), at least one fan, blower, or other air movement device (130), to move air across the condenser and remove heat from the condenser, a liquid bypass valve (160) which controls the bypassing of flow or refrigerant that would normally flow to the evaporative cold plates and other devices being evaporatively cooled, a hot-gas bypass valve (170) which bypasses compressor discharge flow allowing it to return directly to the compressor inlet, and, in some implementations, may include a thermal energy storage device (110) (not drawn to scale) which is shown located in the flow path after the condenser, but can also be located just upstream of the condenser, a receiver (140), and an accumulator (150). The condenser (120) may be air-cooled or liquid-cooled. In the case of a liquid-cooled condenser, the at least one fan, blower, or other gas movement device (130) is not required, instead a liquid moving device such as a pump is used. In extreme operating modes, a receiver (140) and an accumulator (150) may further stabilize the system. The direct vapor compression system supplies a high-pressure liquid refrigerant to the cold plate assembly(s) at the liquid supply (80) and receives a low-pressure vapor refrigerant from the cold plate assembly(s) at the vapor return (90). Superheated vapor at low pressure (320) is compressed in the compressor (100) to a high pressure superheated state in stream (180). Refrigerant stream (180) is split in a flow splitting device (190) into two streams: stream to condenser (200) and hot gas bypass stream (210). Stream (210) is controlled by the hot-gas bypass valve (170). Stream (200) can be partially cooled in the optional thermal energy storage device (110) if the thermal energy storage device is located before the condenser (120) (not shown). Alternatively, as shown in FIG. 2, stream (200) is cooled and partially or fully condensed by the cooling action of the condenser (120) and then the stream (220) leaving condenser (120) enters the thermal energy storage device (110) where the refrigerant is completely condensed and further cooled to a subcooled liquid state as stream (230).

The subcooled liquid stream (230) is split in a flow splitting device (240) into streams (250) and the liquid bypass stream (260). The flow of stream (260) is controlled by the liquid bypass valve (160). Stream (250) enters the optional receiver (140). Typically, a liquid reserve is maintained in the receiver (140) to help with transient response of the system and ensure a consistent liquid supply (80) is discharged from the receiver under transient conditions where the condenser (120) is unable to maintain liquid conditions. It needs to be understood that the terms line, stream, passage, and channel are to be consider describing the pathways for refrigerant to move through the implementations disclosed within the present disclosure as a person of ordinary skill in the art would understand in light of their knowledge and reading the present disclosure.

Under conditions where the cold plate assembly(s) (30), (40), (50), and/or evaporator (60) require less liquid than the system is capable of supplying, the hot gas and liquid bypass valves (160) and (170), respectively, are used to maintain acceptable operating conditions with the compressor (100) operating at a steady operating condition. The high pressure superheated vapor stream (210) is throttled across the hot gas bypass valve (170) to a low-side pressure in stream (330). The high-pressure subcooled liquid stream (260) is throttled across the liquid bypass valve (160) to the low-side pressure in stream (290). The return vapor stream (90) is combined with the throttled liquid bypass stream (290) in a mixing device (270). The combined stream (280) enters the accumulator (150). The throttled hot gas bypass stream (330) is combined with the stream (300) leaving the accumulator in a combining device (310). The combined stream (320) enters the compressor.

Exact placement of the accumulator (150), receiver (140), and thermal energy storage device (110) can be varied (not shown) to accomplish the same or similar function. The thermal energy storage device (110) can be placed anywhere between the compressor (100) discharge (180) and the inlets to the cold plate assembly(s) (30), (40), (50), and/or evaporator (60). The accumulator (150) can be placed anywhere between the cold plate assembly(s) (30), (40), (50), and/or evaporator (60) and compressor (100) inlet or can be directly included into cold plate assembly(s) (30), (40), or (50). The receiver (140) can be placed anywhere between the condenser (120) outlet and the cold plate assembly(s) (30), (40), (50), and/or evaporator (60). The receiver can also be incorporated into the condenser (120) itself.

Figure 3:
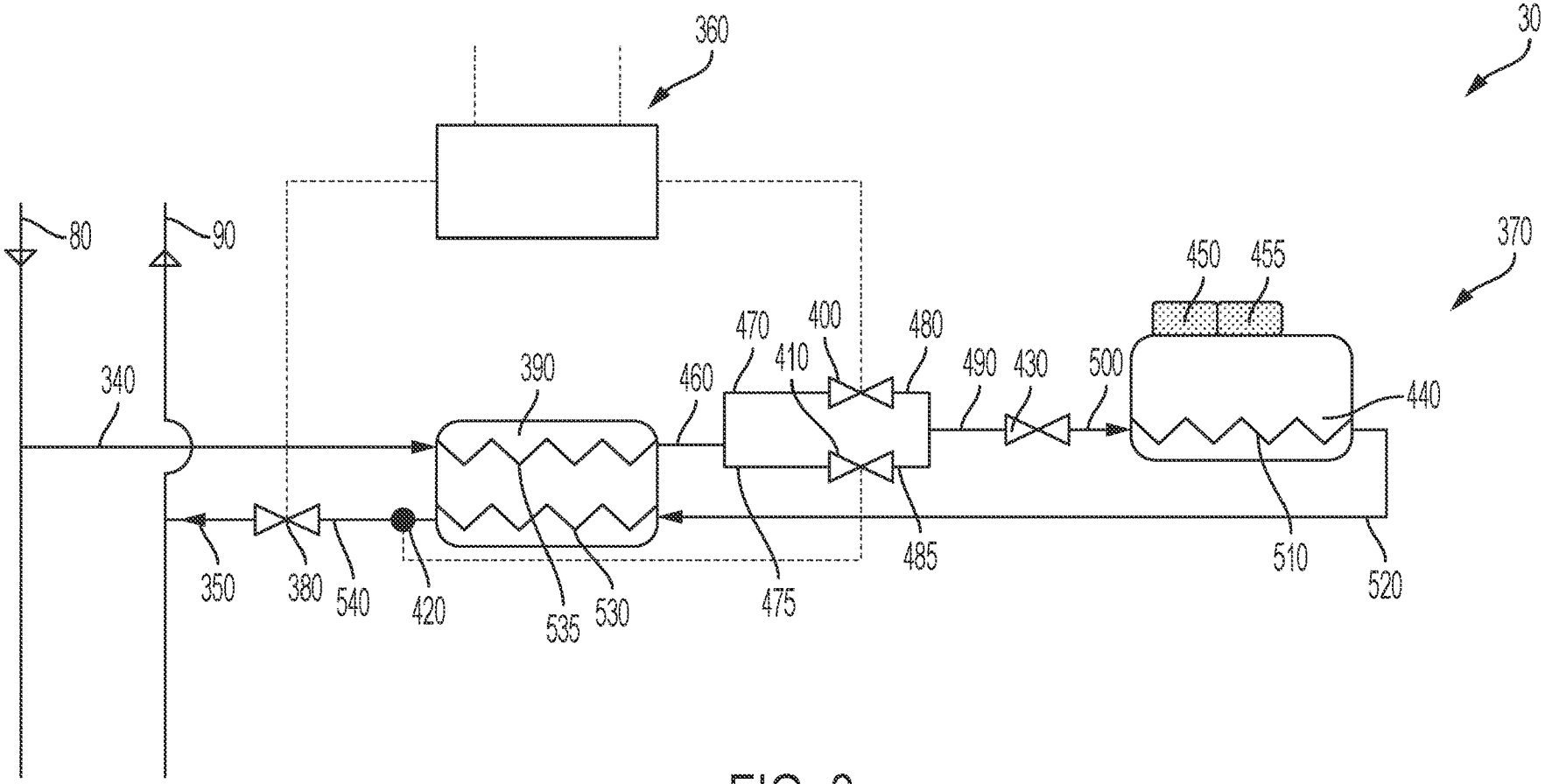
FIG. 3 shows a schematic view of a cold plate assembly with a single control module and single cold plate module.

Referring to FIG. 3, in at least one implementation, an individual cold plate assembly (30) has a control module (360), a cold plate module (370) and a pressure regulating device (380). To assure superheat refrigerant leaves the cold plate assembly (30) at (350), and the sensor 420 for the expansion valve 410 is measuring superheat vapor a recuperator (390) is used to transfer heat from at least one stream (535) to at least one stream (530), and a parallel flow valve assembly that includes, in one implementation, an electronically-actuated valve (400), and an thermal expansion valve (410) with sensing device (420) which is a device that enacts a motion on the integrated expansion valve (410) in response to externally-applied pressure due to the temperature measured by sensing device (420). One example of a sensing device (420) is a bellows-type device which increases/decreases in at least one dimension, such as length, to open/close the integrated expansion valve (410) based on the fluid temperature and externally-applied pressure. Bellows-type devices are typically filled with one or more refrigerants at vapor/liquid equilibrium conditions. While other sensing elements or devices and actuator mechanisms are common for actuating thermostatic expansion valves (e.g. bulb and diaphragm, piston, etc.), we have found that for rapid heat addition transients a bellows-type or implemented like device or element that serves as both the sensor and actuator, and implemented as a single integrated unit, is superior to all other implementations. We have found that an implementation of a sensing implement (420) having a combination of a high surface area, low mass, and ability to be immersed directly into the effluent stream of the cold plate (evaporator) reduces its response time dramatically relative to other implementations, and therefore, allows for much more precise temperature control during oscillatory or sudden heat applications. Alternatively, a combination of a temperature sensing device, such as a thermocouple or RTD, with a pressure sensing device, such as an absolute pressure transducer, can be used as a sensing device (420). In one implementation, the cold plate module (370) has a cold plate (440) with at least one refrigerant pass (510). In one possible configuration, the one or more cold plate fluid passages (510) are machined into one or both of the top (442) and bottom (441) plates which are then brazed, welded or mechanically fastened together to form a cold plate (440) with internal flow passages (510). At least one temperature sensitive heat generating device (450) is in thermal communication with the cold plate top surface (442) and/or bottom surface (441), and it is contemplated that additional heat loads (455) which may be temperature sensitive or insensitive may be present. The cold plate module (370) may also contain an orifice plate (430) for refrigerant flow control. High-pressure subcooled refrigerant liquid from the main supply stream (80) via stream (340) flows into the recuperator where it is further subcooled by transferring heat from the (535) high pressure subcooled flow path to the lower pressure superheated vapor flow path (530). The subcooled liquid stream (460) leaving the recuperator is optionally split into streams (470) and (475). The flow of optional stream (470) is modulated by the electronically-actuated rapidly acting valve (400) which receives command signals from the control module (360). While the flow of stream (475) is controlled by the thermal expansion valve (410) which relies on the control sensor (420), alternatively an electronic expansion valve could have been used instead of the thermal expansion valve, and then the sensor (420) readings would be monitored by the control module (360) and the control module would control the opening and closing of the electronic expansion valve (this configuration is not shown in FIG. 3). It is also understood, that since both the electronic expansion valve and the rapidly opening valve are plumbed in parallel, and both controlled by the same control module (360). if a rapidly responding electronic expansion valve was developed, it could function in place of both valves, meaning a single valve could replace the parallel paths with two separate valves.

The purpose of the optional parallel stream (470) which has the rapidly acting electronic control valve (400) is for situations where it is known beforehand that a surge in cooling is needed, or a thermal surge is observed, and the expansion valve cannot open fast enough to avoid a temperature spike in the cold plate, so the rapidly acting vale opens first then once the expansion valve has opened, the rapidly acting valve can be closed. The natural question to ask is that if a rapidly actuating valve can be made, why not simply make the expansion valve rapidly reacting? The reason for two distinct valves in many cases is that the expansion valve is purposely designed to be slower responding, that is have some damping or thermal inertia, to avoid the well known expansion valve issue known as hunting, especially in the case of the thermal expansion valve. (An electronic expansion valve can have the control module adjust electronically the response time, but real time adjustment of a thermal expansion valve cannot occur.) The rapidly acting valve has no hunting issues, since it is sized to be fully opened and remain that way, until the expansion valve catches up, and is only used in the case of a thermal surge that is known beforehand or a thermal spike observed by the control module (360) because the expansion valve cannot open fast enough.

The pressure of stream (470) is reduced across the electronically actuated rapidly acting valve (400) to an intermediate pressure in stream (480). The pressure of stream (475) is reduced across the integrated expansion valve (410) to the same intermediate pressure in stream (480) since streams (480) and (485) are combined to stream (490) that enters the cold plate module (370). The pressure of stream (490) can be further reduced to the cold plate pressure by incorporating a flow control orifice plate (430) to stream (500) which enters the cold plate (440) as stream (510). In one preferred embodiment, this flow control orifice is located in the cold pate and if more than one parallel flow passages is used in the cold plate, it is more advantageous to have multiple orifices (430) at the inlet to each individual flow passage, after the flow has been split up rather than have the orifice (430) upstream of the flow split. By having the orifices after the flow split, passage to passage flow balancing is improved and the potential for flow instability is reduced.

The combined effect of the electronically-actuated valve (400), the integrated thermal or electronic expansion valve (410), and the optional control orifice plates (430) result in the refrigerant stream (510) entering into the one or more parallel, series or combination of parallel and series passages of the cold plate (440) as a two-phase fluid with a very low thermodynamic quality. The refrigerant stream (510) accepts heat from the heat generating components (450) and (455). To avoid well known two-phase heat transfer evaporation issues, such as dryout and critical heat flux, as well as to assure more uniform cold plate temperatures, the refrigerant stream (520) many times is designed to leave the cold plate at a thermodynamic quality less than 1, meaning it remains a two-phase saturated mixture of liquid and vapor. The two-phase refrigerant stream (520) enters the recuperator as stream (530) where the refrigerant is superheated by the cooling of refrigerant stream (535). The sensing device (420) adjusts the thermal expansion valve (410) position based on the pressure or temperature of the superheated refrigerant stream (540) leaving the recuperator (390). As stated earlier if an electronic expansion valve is used, the control module (360) similarly adjusts the electronic expansion valve position based on the pressure or temperature of the superheated refrigerant stream (540) that is monitored by the control module (360).

The pressure regulating device (380), which can be an electrically activated valve controlled by the control module, opens and closes as needed to control the pressure of stream (540) and thus the evaporating temperature (saturation temperature) of the cold plate refrigerant stream (510). Stream (540) is throttled to the pressure of and mixed with vapor return (90). For example, if valve (380) is fully opened, and therefore has negligible pressure drop, the pressure in stream (540) is only negligibly higher than the pressure of the stream at (350) which is only negligibly higher than the pressure of stream (90). Alternatively, if valve (380) is partially closed to create a significant pressure drop, the pressure in stream (540) is significantly higher than the pressure of the stream at (350), but can never exceed the pressure of stream (80) which is determined by the vapor compression system (20). Of course, the pressure of the stream at (350) remains only negligibly higher than the pressure of stream (90).

Figure 3A:
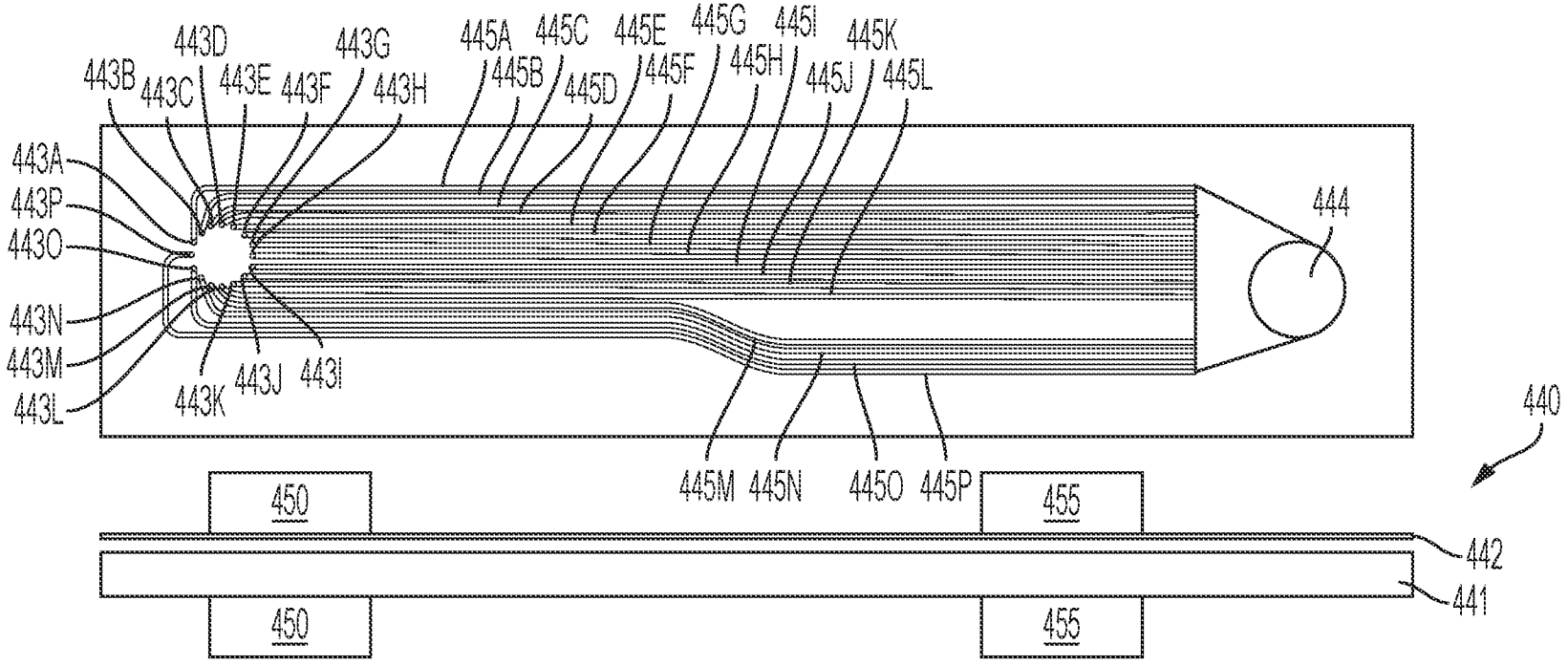
FIG. 3A shows channels within the base plate of the cold plate.

Referring to FIG. 3A, in at least one implementation, the cold plate (440) has a base plate (441), a cover plate (442), a plurality of inlets (443A) to (443P), a plurality of individual microchannels (445A) to (445P) (which, in some implementations, can range in size from 100 microns to 3 mm), and a singular outlet (444). Alternatively, in other implementations, a plurality of outlets may be used which combine downstream of the cold plate (440), prior to the pressure regulating device (380). The plurality of inlets are fabricated into the base plate (441) or the cover plate (442). The cover plate and base plate are bonded or attached (either by mechanically, brazed, welded, adhesive, diffusion-bonded, or a combination of such) to seal the internal fluid from the external environment. The plurality of heat generating components (450) and (455) are attached to the external surface of the cold plate. Stream (500) (see FIG. 3) enters the cold plate (440) through the plurality of inlets (443A) to (443P). The fluid streams within the cold plate (440) are maintained separate through all or most of the cold plate (440) as individual components of stream (510) (see FIG. 3). All components of stream (510) are recombined into a singular stream at the cold plate outlet (444) to exit the cold plate as a singular stream (520) (see FIG. 3). The fluid which enters the cold plate (440) through inlet, is maintained isolated in microchannel throughout the cold plate as stream.

Maintaining individual streams within the cold plate (440) has several advantages that increase the system's ability to maintain temperature uniformity. First, the channel geometries (such as, for example, rectangular, circular, hemispherical, elliptical) can be locally altered to significantly increase local heat transfer coefficients under areas of high heat flux and control local pressure drop that in turn controls the refrigerant local temperature. Second, most cold plates have non-uniform cooling requirements relative to the cold plate surface. Individual channels allows the designer to direct precise cooling to the exact location the cooling is required. Third, maintaining separate streams prevents the accumulation of liquid (or vapor) from accumulating in one region of the cold plate. Since liquid and vapor have substantially different heat transfer characteristics, especially in this application, ensuring consistent liquid (or vapor) inventory at each cold plate location is critical for consistent performance.

Figure 3B:
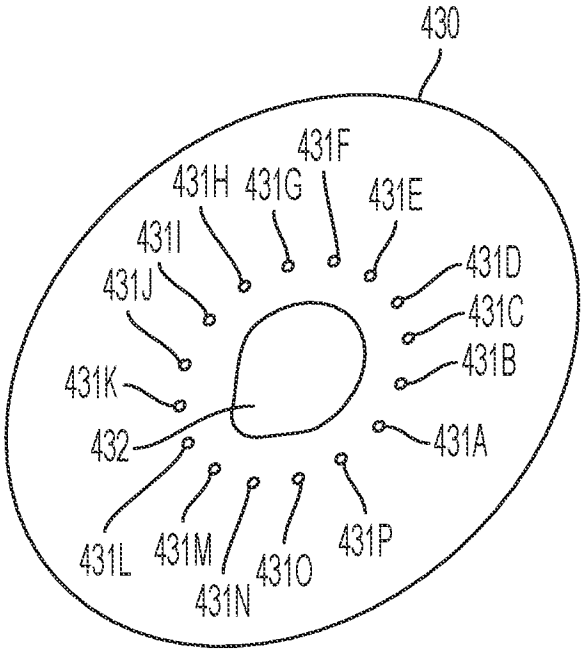
FIG. 3B shows an orifice plate.

Referring to FIG. 3B, in one implementation, the orifice plate (430) may function as a flow splitting and flow distribution device to presplit stream (500) prior to entering the cold plate (440). One implementation of the orifice plate has a plurality small orifice openings (431A)-(431P). Upstream all fluid exists as a singular stream, stream (490), ideally in the liquid phase, at the inlet of the orifices. This most commonly is achieved through a common cavity (not shown). A fraction of stream (490) passes through each orifice opening (431A)-(431P). Downstream of the orifice plate, stream (500) separated into individual components of stream (500). Each stream component of stream (500) is then introduced, individually, to the cold plate inlets (443A) to (443P). For example, the fluid from stream (490) that passes through the orifice (e.g., 431A) is maintained as an individual stream, enters the cold plate (440) through inlet opening (e.g., 443A). The sizing of the orifice openings are such that a precise flow balance between the orifice openings (431A)-(431P), and subsequently through each microchannel (445A) to (445P), is achieved. The balance of flow through the orifice openings is dependent on the distribution, placement, and intensity of the heat loads on the cold plate (440). Rather than a separate orifice plate (430), the orifice plate (430) functionality may be directly integrated into the cold plate (440) by sizing of the individual inlet openings to each passage (443A) to (443P) or adding a restriction at the inlet of the microchannel passages (445A) to (445P). In the preferred embodiment, the stream (490) enters the orifice plate (430) completely in the liquid phase. In this configuration, precise distribution to all orifices is easily achieved. If vapor was present, the possibility exists one orifice receives entirely vapor flow, which would result in the inability to achieve cold plate temperature uniformity. Referring to FIG. 3, in the preferred embodiment, the expansion valve (410) and optional rapidly acting valve (400), do not drop the pressure of the incoming subcooled liquid fluid so much as to cause the fluid to flash into a two-phase mixture of saturated liquid and vapor, rather the throttled fluid stream at (490) remains all saturated or subcooled liquid, allowing the liquid to evenly disperse to the numerous orifices (431A-431P) at the beginning of the flow passages (441A-441P) and the additional pressure drop of the orifices results in the flashing of the refrigerant into a saturated two-phase mixture of liquid and vapor, but at this point, the fluid has already been evenly distributed to the passages.

Figure 4:
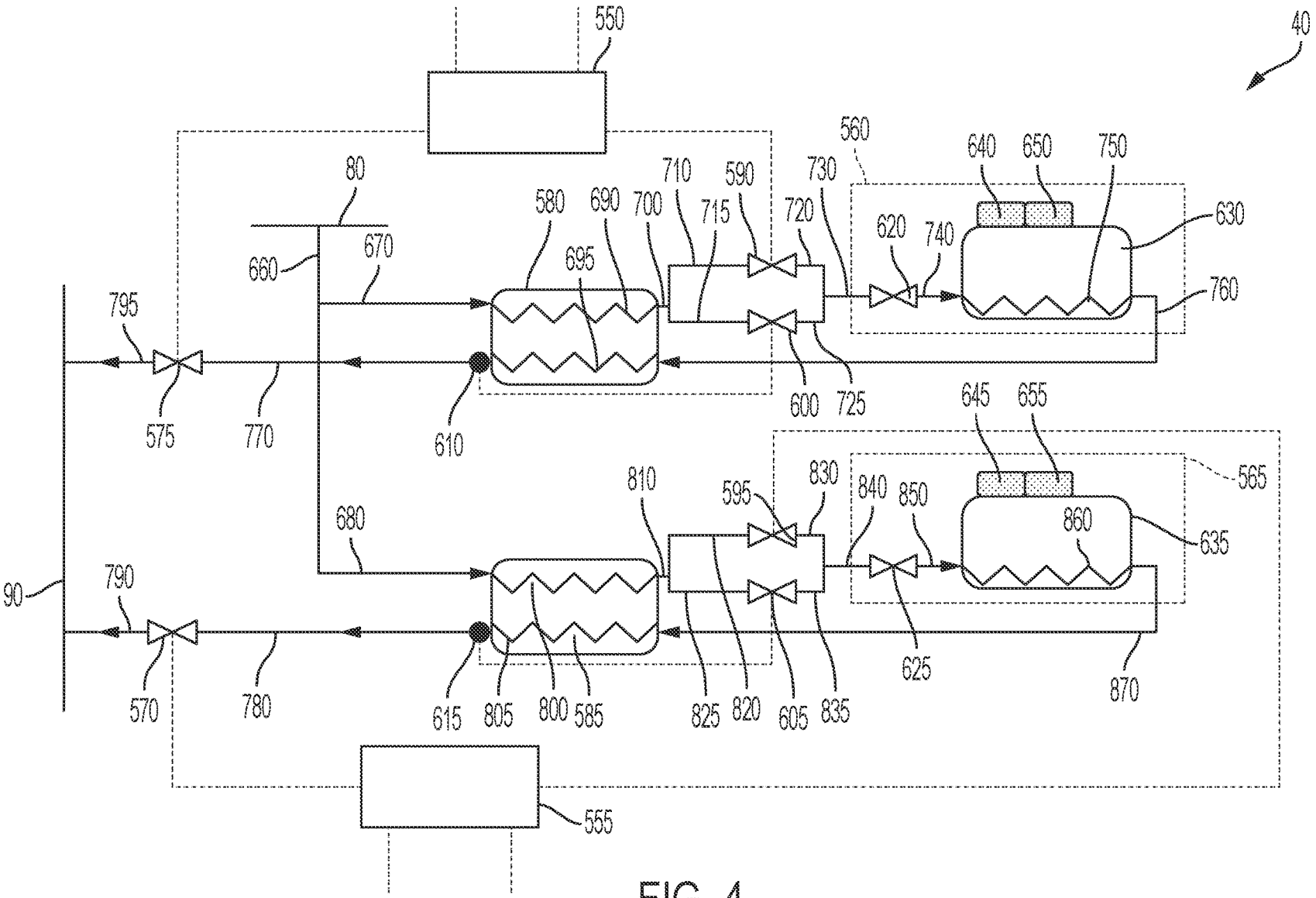
FIG. 4 shows a schematic view of a cold plate assembly with multiple control module with cold plates in parallel.

Referring to FIG. 4, in one implementation, the group of cold plate assembly(s) of type I (40) includes at least two control modules (550) and (555), at least two cold plate modules (560) and (565), and two pressure regulating devices (570) and (575). The control modules (550) and (555) individually control the accompanying cold plates (560) and (565), respectively. The control modules (550) and (555) and cold plates (560) and (565) may be sized identically or sized to accommodate different temperature sensitive heat generating components (640) and (645) with similar surface temperature requirements. The first control module (550) has a recuperator (580) with at least two streams (690) and (695), an electronically-actuated valve (590), and an integrated expansion valve (600) with sensing device (610), such as a bellows-type implementation. The first cold plate module (560) has a cold plate (630) with at least one refrigerant pass (750), wherein at least one temperature-sensitive heat generating device (640) is in thermal communication with the cold plate (630). The cold plate module may also contain one or more orifice plates (one is shown for the 1 passage shown) (620) for refrigerant flow control as well as additional heat loads (650) which can be in thermal communication with the cold plate (630) and such loads may be temperature sensitive or insensitive.

The second control module (555) includes a recuperator (585) with at least two streams (800) and (805), an electronically-actuated valve (595), and an integrated expansion valve (605) with sensing device (615). The second cold plate module (565) includes a cold plate (635) with at least one refrigerant pass (860), wherein at least one temperature sensitive heat generating device (645) is in thermal communication with the cold plate (635). The cold plate module may also contain an orifice plate (625) for refrigerant flow control as well as additional heat loads (655) which can be in thermal communication with the cold plate (635) and said loads may be temperature sensitive or insensitive.

In one implementation, stream (660) is drawn from the high-pressure liquid supply (80). The stream (660) is split into streams (670) and (680). The flow of stream (670) is controlled by activation of the pressure regulating control valve (575) by control module (550) and the flow of stream (680) is controlled by activation of the saturation pressure (saturation temperature) regulating control valve (570) by control module (555).

The recuperator (580) accepts high pressure subcooled refrigerant liquid from the main supply stream (80) via stream (670) and this refrigerant is further subcooled by the recuperator (580) as stream (690). The subcooled liquid stream (700) leaving the recuperator is optionally split to streams (710) and (715). The flow of stream (710) is controlled by the optional rapidly acting electronically-actuated valve (590). The flow of stream (715) is controlled by the expansion valve (600). The pressure of stream (710) is reduced across the electronically actuated valve (590) to an intermediate pressure in stream (720). The pressure of stream (715) is reduced across the expansion valve (600) to the same intermediate pressure in stream (720). Streams (720) and (725) are combined to stream (730) that enters the cold plate module (560). The pressure of stream (730) is reduced to the cold plate pressure by flowing through a flow control orifice plate (620) to stream (740) which enters the cold plate as stream (750). For simplicity of explanation, a single orifice and a single flow passage have been shown, however, it is understood that multiple flow passages in parallel each with their own orifice at the inlet to the passage is contemplated. The refrigerant stream (750) accepts heat from the heat generating components (640) and (650). In one implementation, to avoid known two-phase heat transfer issues, the refrigerant stream (750) leaves the cold plate at a thermodynamic quality less than 1, that is a two phase mixture of saturated liquid and vapor. The two-phase refrigerant stream (760) enters the recuperator as stream (695) where the refrigerant is superheated due to the heat transfer from the warmer refrigerant stream (690). The sensing device (610) adjusts the expansion valve (600) position based on the temperature to assure that a superheated refrigerant stream (770) leaves the recuperator (580). The pressure regulating valve (575) is partially opened or closed to provide a pressure drop, thereby allowing the saturation pressure of the refrigerant evaporating in the cold plate, that is stream (750), to be controlled to essentially any desired pressure (and have evaporation in the cold plate to any desired saturation temperature) within a range that can vary from a saturation pressure (and thus saturation temperature) slightly below the pressure of stream 700 to as low as slightly above the pressure in return line 90. This partial opening or closing of the pressure regulating valve (575) is controlled by control module (550).

It is worth noting, that the saturation temperature of the second cold plate (635), that is the saturation temperature of stream (860) can be independently controlled to essentially any desired pressure (and have evaporation in the cold plate to any desired saturation temperature) within a range that can vary from a saturation pressure (and thus saturation temperature) slightly below the pressure of stream 700 to as low as slightly above the pressure in return line 90, by adjusting the partial opening or closing of the pressure regulating valve (570) which is controlled by control module (555). Also, while individual control modules (550) and (555) have been shown, it is understood that these control functions could be combined into a single control unit.

Recuperator (585) accepts high pressure subcooled refrigerant liquid from the main supply stream (80) via stream (680) and this refrigerant is further subcooled by the recuperator (585) as stream (800). The subcooled liquid stream (810) leaving the recuperator is optionally split to streams (820) and (825). The flow of stream (820) is controlled by the electronically-actuated valve (595). The flow of stream (825) is controlled by the expansion valve (605). The pressure of stream (820) is reduced across the electronically actuated valve (595) to an intermediate pressure in stream (830). The pressure of stream (825) is reduced across the expansion valve (605) to the same intermediate pressure in stream (830). Streams (830) and (835) are combined to stream (840) that enters the cold plate module (565). The pressure of stream (840) is reduced to the cold plate pressure across a flow control orifice plate (625) to stream (850) which enters the cold plate as stream (860). The refrigerant stream (860) accepts heat from the heat generating components (645) and (655). In one implementation, the refrigerant stream (870) leaves the cold plate at a thermodynamic quality less than 1. The two-phase refrigerant stream (870) enters the recuperator as stream (805) where the refrigerant is superheated by the flow of the warmer refrigerant stream (800). The sensing device (615) adjusts the expansion valve (605) position based on the temperature to assure that a superheated refrigerant stream (780) leaves the recuperator (585). The pressure regulating valve (570) is partially opened or closed to provide a pressure drop, thereby allowing the saturation pressure of the refrigerant evaporating in the cold plate, that is stream (860), to be controlled to essentially any desired pressure (and have evaporation in the cold plate (635) to any desired saturation temperature) within a range that can vary from a saturation pressure (and thus saturation temperature) slightly below the pressure of stream (810) to as low as slightly above the pressure in return line (90). This partial opening or closing of the pressure regulating valve (570) is controlled by control module (555).

Additional control modules and cold plates can be plumbed in parallel with supply streams drawn from stream (660) and return streams flow into stream (90). It is also understood that a single control module could be used to replace individual control modules and that the control modules also control both the compressor hot gas bypass valve (170) of FIG. 2, to modulate the net refrigerant flow from the compressor and therefore the heat rejected by the Condenser (120) of FIG. 2 and control the cold-plate bypass valve (160) of FIG. 2 to also modulate the cooling capacity of the vapor compression system and therefore the heat rejected from the condenser, and provide additional cooling to the compressor (100). Finally it is to be understood, that instead of the controlling compressor flow with the hot gas bypass valve (170), a variable speed compressor could be used, or multiple compressors could be used in a parallel flow arrangement, where turning one or more compressors on and off affects the total refrigerant flow of the compressor assembly. Similarly, instead of controlling the net heat rejection of the condenser, by controlling the bypass valve 160, a variable flow fan could be used instead of a fixed flow fan (130) in FIGS. 2A and 2B. Also if the condenser was liquid cooled, instead of air cooled, a variable flow pump could be used instead of a fixed flow pump. It should also be understood that a combinations of these methods, namely fan or pump speed modulation and variable speed operation of one or more compressor can be combined with hot gas bypass and cold plate bypass (liquid bypass).

Figure 5:
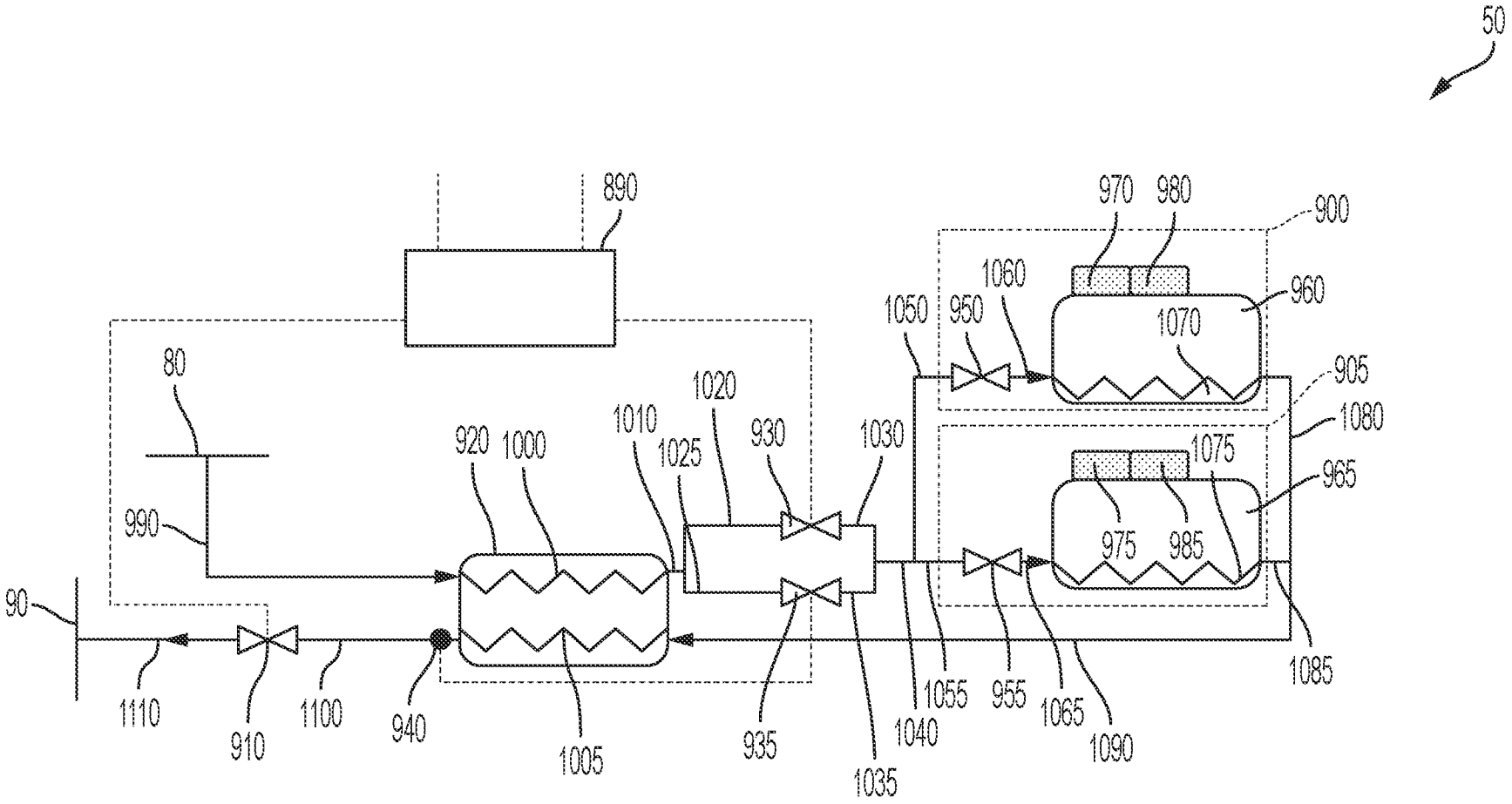
FIG. 5 shows a schematic view of a cold plate assembly with a single control module and multiple cold plates in parallel.

Referring to FIG. 5, in one implementation, the group of cold plate assembly(s) of type II (50) has a single control module (890), at least two cold plate modules (900) and (905), a single recuperator (920) and a pressure regulating device (910). The recuperator (920) is sized to accommodate the flow of the at least two cold plates (900) and (905). The at least two cold plates (900) and (905) may be sized identically or sized to accommodate different temperature sensitive heat generating components (970) and (975) with similar isothermal temperature requirements. If it was desired for the two cold plates to operate at different temperatures, then two pressure regulating devices would be needed (not shown) in the return flow stream before they are combined, that is one in flow stream (1085) and another in flow stream (1080), rather than after the flow streams were combined into stream (1100).

The recuperator (920) has at least two streams (1000) and (1005), and as previously described in prior configurations (FIG. 3), the subcooled liquid refrigerant flow stream (1010) is optionally split into two parallel flow paths (1020) and (1025), where the optional flow through stream (1020) is controlled by an electronically actuated valve (930) for fast response opening and the flow through stream (1025) is controlled by expansion valve (935) with sensing device (940), or as previously stated they could both be controlled by control module 890.

The first cold plate module (900) has a cold plate (960) with at least one refrigerant pass (1070), wherein at least one temperature sensitive heat generating device (970) is in thermal communication with the cold plate (960), further additional heat load(s) (980) which may be temperature sensitive or insensitive may also be in thermal communication with the cold plate (960). The cold plate module may also contain an orifice plate (950) for refrigerant flow control. The second cold plate module (905) has a cold plate (965) with at least one refrigerant pass (1075), wherein at least one temperature sensitive heat generating device (975) is in thermal communication with the cold plate (965), further additional heat load(s) (985) which may be temperature sensitive or insensitive may also be in thermal communication with the cold plate (965). The cold plate module may also contain an orifice plate (955) for refrigerant flow control.

In one implementation, stream (990) is drawn from the high-pressure liquid supply (80). The flow of stream (990) is controlled by the partial or complete opening or closing of the pressure regulating valve (910), the expansion valve (935) and the rapidly actuating valve (930) as well as the pressure of flow streams (80) and (90). The control module (890) can control all of these valves, as well as controlling the pressure in flow streams (80) and (90) by adjusting these valves as well as adjusting the hot gas bypass, cold plate bypass, condenser cooling rate and compressor speed. The expansion valve can either be independently controlled, based solely on the temperature of sensor (940) to maintain the desired exit superheat, as is the case when a traditional thermal expansion valve or conventional electronic expansion valve is used or controlled by the control module (890) to control an electronically actuated expansion valve.

As stated earlier, the pressure of stream (1020) is reduced across the electronically actuated valve (930) to an intermediate pressure in stream (1030). The pressure of stream (1025) is reduced across the expansion valve (935) to the same intermediate pressure in stream (1035). Streams (1030) and (1035) are combined to stream (1040). Stream (1040) is split into at least two streams (1050) and (1055) corresponding to the at least two cold plate modules (900) and (905). The flow of streams (1050) and (1055) are not individually-controlled, although they could be with the additional of control valves in each of these two streams. Stream (1050) enters the cold plate module (900). The pressure of stream (1050) is reduced to the cold plate pressure across a flow control orifice plate (950) to stream (1060) which enters the cold plate as stream (1070) as a two-phase refrigerant with a low thermodynamic quality. The refrigerant stream (1070) accepts heat from the heat generating components (970) and (980). Typically, the refrigerant stream (1070) leaves the cold plate at a thermodynamic quality less than 1, and this two-phase refrigerant stream is identified as stream (1080). Stream (1055) enters the cold plate module (905). The pressure of stream (1055) is reduced to the cold plate pressure across a flow control orifice plate (955) to stream (1065) which enters the cold plate as stream (1075) as a two-phase refrigerant with a low thermodynamic quality. The refrigerant stream (1075) accepts heat from the heat generating components (975) and (985). Typically, the refrigerant stream (1075) leaves the cold plate at a thermodynamic quality less than 1 and this two phase refrigerant stream is identified as stream (1085). The two streams (1080) and (1085) are combined into stream (1090). Stream (1090) enters the recuperator as stream (1005) where the refrigerant is heated by the refrigerant stream (1000). The sensing device (940) adjusts the expansion valve (935) position to assure that stream (1100) is a superheated refrigerant leaving the recuperator (920).

The pressure of stream (1100), and therefore the pressure and thus the saturation temperature of the two phase refrigerant in the one or more flow passages (1070) in cold plate (960) as well as the saturation temperature in the one or more flow passages (1075) in cold plate (965) is controlled by the pressure regulating device (910). In one preferred embodiment, this pressure regulating device is an electrically actuated valve, which is controlled by control module (860) to provide a pressure drop across the valve (910), by the partial opening position of this valve (910) and thereby adjust the pressure and thereby control the evaporating temperature in cold plate passages (1070) and (1075). The pressure adjustment is only possible in a range between the pressures in stream (80) and (90). Stream (1110) is mixed into the return stream (90).

Figure 6:
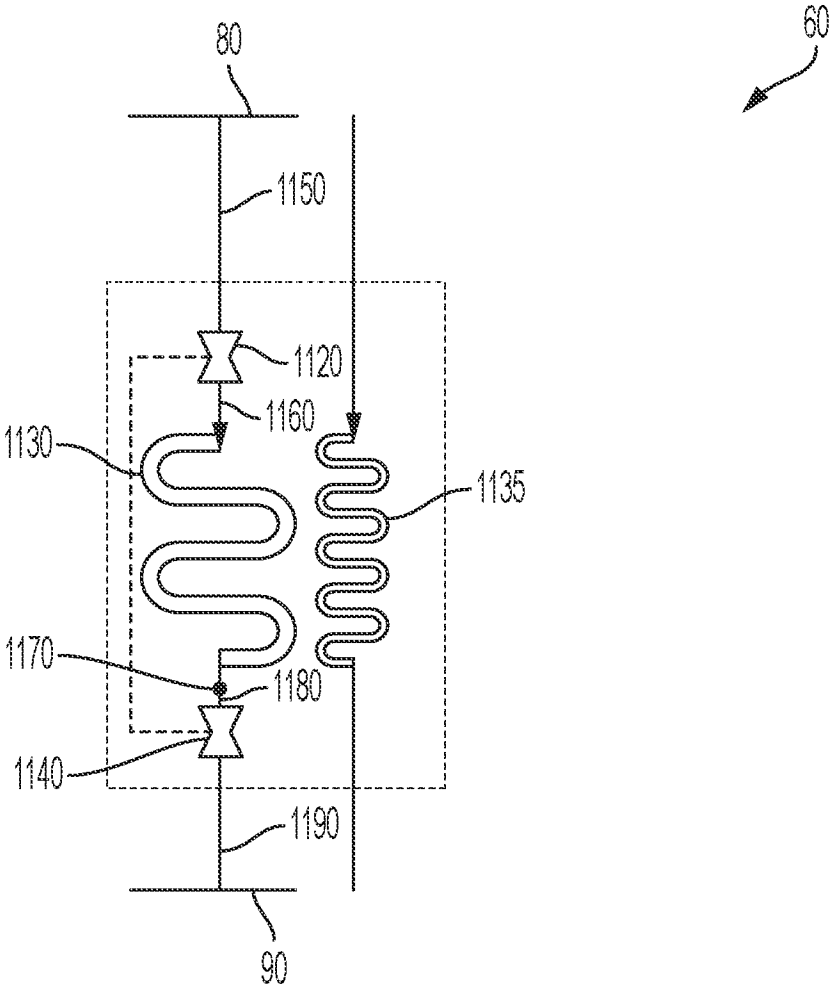
FIG. 6 shows a schematic view of a single evaporating refrigerant to fluid heat exchanger.

Referring to FIG. 6, in one implementation, an auxiliary evaporative heat exchanger (60) has an inlet flow stream 1150, expansion valve (1120), one or more heat exchanger refrigerant flow passages (1130), and a pressure regulating device (1140). The pressure regulating device (1140) controls the saturation temperature of the fluid evaporating in the heat exchanger refrigerant passages (1130) by controlling the pressure of the refrigerant evaporating in heat exchanger refrigerant passages (1130), where the pressure can be adjusted to a range from slightly below the supply pressure stream (80) to slightly above the pressure in return stream (90). Slightly below and above, is due to the unavoidable pressure drops in valves (even when opened) and piping associated with the flowing of the fluid. The heat exchange refrigerant fluid passage (1130) is thermally coupled to another one or more vapor (such as air) or fluid passages (1135). Heat exchanger design is well known in the art, and as is well understood, this heat exchanger can for example be co-current, counter-current, or cross-flow configurations and use parallel, series or parallel/series flow configurations all well known in the art.

The auxiliary evaporator (60) is supplied refrigerant from the supply stream (80) as stream (1150). Stream (1150) is throttled to the evaporator pressure by the expansion valve (1120) to stream (1160). Stream (1160) enters heat exchange refrigerant passage (1130) where the refrigerant accepts heat from the coupled fluid or air stream (1135). Using sensor (1170), the expansion valve adjusts the refrigerant flow in passage (1130) so that the refrigerant exits the heat exchanger as a superheated vapor as stream (1180). Stream (1180) flows through pressure regulating device (1140) exiting as stream (1190) which is mixed into the return stream (90).

Referring to FIG. 1A. and FIG. 1B, in the present disclosure of the control concept, the system (10) is designed to provide a controllable supply stream (80) and suction stream (90) conditions to at least one cold plate assembly(s) (30), (40), (50), and/or evaporative heat exchanger (60) for the purpose of maintaining one or more potentially different specified temperature conditions on one or more cold plate modules (370), (560), (565), (900), and/or (905) as well as providing isothermal temperature distribution across critical areas of the one or more cold plate modules (370), (560), (565), (900), and/or (905). In one implementation, controllable process conditions are defined as controlled pressure, controlled enthalpy, and controlled concentration, if using a multicomponent mixture, or equivalent thermodynamic conditions. Maintaining cold plate surface temperatures nearly isothermal is most challenging under a pulse event or a transient thermal load where cold plate(s) (440), (630), (635), (960), and/or (965) with temperature sensitive heat generating device(s) (450), (640), (645), (970) and/or (975) fluctuate between a low heat generation capacity and a high heat generation capacity (for example, 0% to 100%). One or more control module(s) (360), (550), (555), and/or (890) must adjust the electrically actuated valves that control hot gas bypass (170), cold plate bypass (160), saturation temperature in the cold plates (440), (630), (635), (960) and/or (965), saturation temperature in the evaporative heat exchanger (60), rapid acting heat pulse accommodating valves (400), (590), (595) and/or (930), and optionally control the expansion valves ((410), (600), (605), (935) and/or (1120). The Control Module may also control the speed of the one or more compressors and the flow rate of the vapor or liquid cooling flow that removes heat from the condenser. The one or more control modules, perform all these operations to maintain active cooling of the temperature sensitive heat generating devices(s) (450), (640), (645), (970) and/or (975). However, for refrigerant charge maintenance and system stability, the refrigerant flowrate must be tightly controlled to prevent substantial liquid refrigerant from exiting the cold plate assemblies and entering the return stream (90), since fluid cannot be compressed by the compressor (100). In one implementation, a single Control Module (70) of FIG. 7, that actively monitors all process conditions and adjusts all these settings at a rate of 0.5 Hz or greater.

Referring to FIG. 2, during operation, in one implementation, the direct vapor compression system (20) supplies only enough liquid via the supply stream (80) to meet the required cooling of the cold plate assembly(s) (30), (40), (50), and/or evaporative heat exchanger (60). In one implementation, the compressor (100) of the direct vapor compression system (20) remains operating above 85% of peak flow during possible heat generating devices(s) (450), (640), (645), (970) and/or (975) pulse events. Peak capacity is defined as 100% of the refrigerant flow required to meet the cooling needs of all connected cold plate assemblies and evaporators simultaneously, or other capacity defined by the user or determined by the controller (70) based on input signals. Peak capacity may change through time based on system operation and user input. The controller (70) maintains direct vapor compression system (20) compressor (100) at a flow capacity between 85% and 100% peak capacity between pulse events. In one implementation, the compressor (100) operation may be reduced below 85% of peak capacity to save power during prolonged idle times where a subset or all the cold plate assemblies and evaporators are deemed inactive either by user input or by the controller (70). At the initiation of the pulse event, in one implementation, the controller (70) increases the compressor (100) capacity to 100% of the current peak capacity. The compressor (100) capacity is maintained at this level until the completion of the pulse event. The flow capacity can be adjusted by one or more combinations of varying the speed of the compressor, using multiple compressors plumed in parallel that are turned on and off as needed, using a hot gas bypass circuit to return a portion of the compressor discharged refrigerant to the compressor inlet by the partial opening of the electrically actuated valve (170) of FIG. 2, using a cold plate bypass to return a portion of the condenser outlet refrigerant flow to the compressor inlet by the partial opening of the electrically actuated valve (160) of FIG. 2.

In some implementations, a control system prevents temporary instabilities in supply stream (80) and return stream (90) conditions during a series of pulse events of the heat generating devices(s) (450), (640), (645), (970) and/or (975). As the refrigerant supply stream (80) flow rate fluctuates, the flow of liquid return stream (290) and gas return stream (330) are actively adjusted by actuation of valves (160) and (170) to maintain stable compressor (100) operation, acceptable compressor operating temperature, and acceptable compressor inlet conditions since the combination of the liquid flow stream (290) and the vapor flow stream (330) when mixed with return stream (90) can be adjusted by the setting of control valves (160) and (170) to maintain the compressor inlet conditions within acceptable operating conditions. Thus, the compressor suction stream (320) and discharge stream (180) maintain required flow and process conditions. To maintain operational (i.e., cold plate surface temperature) stability during operation when the cold plate assembly(s) and evaporator(s) require less refrigerant than the flow through the compressor (100), in one implementation, the liquid bypass (160) and hot gas bypass valves (170) allow refrigerant to bypass the main loop to maintain the compressor cooling as well as suction stream superheat and pressure required to prevent compressor damage.

In one implementation, the liquid bypass valve (160) allows a fraction of liquid refrigerant in the condenser outlet stream (230) to mix with return stream (90) creating stream (280). The hot gas bypass (170) allows a fraction of refrigerant compressor discharge vapor stream (180) to mix with stream (280) creating compressor inlet stream (320). The flow of refrigerant into the compressor (100) is actively adjusted by the controller (70) to ensure the compressor suction stream (320) remains at the target superheat, and avoid compressor overheating, compressor slugging and/or other potentially damaging inlet conditions. In one implementation, the hot gas bypass valve (170) allows superheated gas from the compressor discharge stream (180) to bypass the condenser and the main loop to return to the return stream (90) via stream (210)/stream (330). The fraction of flow through the hot gas bypass valve (170) is actively controlled by the controller (70) to maintain the compressor suction stream (320) set point pressure. To set the liquid bypass valve (160) and hot gas bypass valve (170) positions, in one implementation, the controller (70) monitors the thermodynamic state of the superheated refrigerant in the compressor suction stream (320) or other location highly representative of the compressor suction stream (320) process conditions. The most common measurements to define the compressor suction stream thermodynamic state would be pressure and temperature. The controller (70) will monitor thermodynamic states of streams (320), (180), (220), (230), (80) and (90) which is most commonly done using temperature monitoring devices (not shown) and pressure monitoring devices (not shown) in direct contact with the fluid. However, the exact method of monitoring the thermodynamic state is not critical. In one implementation, the liquid bypass valve (160) is configured to make small changes with a change in compressor suction (320) process conditions. The gas bypass valve (170) is configured to change more rapidly with changing compressor suction (320) process conditions. Alternatively, the hot gas bypass valve (170) could be configured to make small changes while the liquid bypass valve (160) makes more rapid changes. However, similar reaction rates between the liquid bypass valve (160) and the hot gas bypass valve (170) should be avoided because if both valves react at the same rate, a resonance can develop causing instabilities.

At the initiation of a pulse event in which one or more of cold plate assembly(s) (30), (40), (50), and/or evaporator (60) require additional refrigerant flow from the supply stream (80), in one implementation, for the initial response, the necessary additional subcooled liquid is supplied from the condenser (120) or receiver (140), if used. To maintain the increased liquid refrigerant supply to the supply stream (80), the bypass valves (160) and (170) are closed by the controller (70). In the case of pressure and temperature, an increased flow through the cold plate assembly(s) and evaporator(s) results in an increase in the compressor suction stream (320) pressure and a decrease in the compressor suction stream (320) superheat. After a brief transient return of two-phase refrigerant in the normally superheated return stream (90), the return refrigerant stream (90) will return to a superheated or saturated vapor state. To maintain the proper compressor inlet conditions of stream (320), the bypass valves (160) and (170) are adjusted by the controller (70) in response to a change in the compressor suction stream (320).

As the cold plate assembly(s) (30), (40), (50), and/or evaporative heat exchanger (60) heat load increases, the condenser (120) must reject additional heat to the cooling medium. In one implementation, the controller (70) monitors the compressor discharge stream (180) pressure via a pressure sensing device (not shown). As the compressor discharge stream (180) pressure increases (decreases), the controller (70) increases (decreases) the cooling fluid flow such that the condenser outlet stream (230) is maintained within acceptable range of the target thermodynamic conditions. In the case where the cooling medium is air, the controller adjusts the fan (130) speed. For forced air flow conditions, instead of increasing or decreasing the fan speed, changing the position of one or more flow dampers (not shown) to alter the air flow may be used instead or combined with fan speed modulation. For liquid coupled condensers, a flow control valve or variable speed pump (neither shown) may be used.

In some implementations, a suction line accumulator (150) may be used at the compressor suction anywhere between stream (90) and (320) to prevent transient slugs of liquid from flowing into the compressor inlet. As shown in FIG. 2, in one implementation, the suction line accumulator (150) is located downstream of the combining of flow stream (90) with liquid flow stream (290) so that the mixed liquid return flow stream (280) can vaporize in the accumulator (150), thereby cooling the mixed stream before leaving the accumulator (150) as a vapor stream (300).

In some implementations, a receiver (140) may be used to provide a liquid buffer at the outlet of the condenser (120) between streams (230) and (80). Alternatively, the internal volume of the condenser (120) may provide sufficient liquid volume such that a receiver (140) is not required.

In some implementations, a thermal energy storage device (110) may be used between the compressor discharge (180) and the supply stream (80) to reduce the required condenser capacity or accommodate thermal load spikes. While the size of the thermal storage device is depicted as small relative to the other components, it is understood, that none of these components are drawn to scale and that the actual size of the thermal storage devices depends, among other factors, on the thermal storage requirement, which in one implementation is directly related to the difference between average heat load requirements and peak heat load requirements. There are clearly situations where the size of the thermal storage device is far greater than the size of the remainder of the vapor compression system (20). In FIG. 2, this thermal storage device (110) is shown plumbed downstream of the condenser, but prior to the liquid bypass connection (240) and in this location the thermal storage device will increase the subcooling of the refrigerant flowing in streams (80) and (260). However, this thermal storage device (110) can be plumbed downstream of the condenser and downstream of the liquid bypass connection (240) and in this location the thermal storage device will only increase the subcooling of the refrigerant stream (80). It is also understood that the thermal storage device (110) can be plumbed upstream of the condenser to reduce the required heat rejection by the condenser. The particular location depends on several factors including the phase change temperature of the thermal storage device and the recharge method. In either case, thermal storage allows the use of smaller condenser components for a given peak capacity.

In one implementation, the direct vapor compression system (20) provides controlled supply stream (80) and return stream (90) process conditions. The cold plate assembly(s) (30), (40), and (50) hardware and the controller (70)

rely on the controlled process streams (80) and (90) to maintain isothermal cold plate surface conditions. The cold plate assembly(s) (30), (40), and (50) control strategy allows the pulse event heat load to vary from 0% to 100% while maintaining isothermal conditions. The controller (70) monitors operating parameters such as a pulse event trigger, power draw of heat generating components, cold plate state (enabled/disabled) or other system specific parameter indicating an operating mode, state, or condition. The controller (70) also monitors stream thermodynamic state of stream (80) and (90). Of interest in these streams is the stream pressure and temperature which are monitored by pressure and temperature sensors (not shown).

In one implementation, the orifice plate(s) (430), (620), (625), (950) and/or (955) are located at the entrance region of each one of the one or more passages of the cold plates (440), (630), (635), (960), and/or (965) and a subcooled liquid is supplied to the inlet of these passages. A liquid state at the entrance of each of the one or more cold plate passages allows the flow to each passage to be used to uniformly distributed. Uniform flow distribution to the individual passages in the cold plates is critical to maintaining the surface isothermal.

Under certain configurations non-temperature sensitive heat generating components accompany temperature sensitive heat generating devices on the same cold plate. In these configurations, it is possible to eliminate the recuperator with the understanding that the entire cold plate will not be isothermal but the segment with temperature sensitive heat generating devices can remain isothermal without any change to the overall system configuration or control strategy. In such implementations, the cold plate would be specifically designed to accommodate this condition with temperature sensitive equipment cooled first (earlier in the flow path) with saturated evaporating refrigerant and then the non-temperature sensitive heat generating devices are cooled with refrigerant that competes the evaporation and becomes superheated to compete the necessary cooling. In this application, the recuperator(s) (390), (580), (585), and/or (920) can still be used to further subcool the liquid entering the cold plates in stream(s) (535), (690), (800), and/or (1000), the stream(s) (530), (695), (805), and/or (1005) are further superheated.

The design of the control module(s) (360), (550), (555), and/or (890) components is critical to effective operation. The fraction pressure difference between the supply stream (80) to return stream (90) in the electronically actuated valve(s) (400), (590), (595), and/or (930), the expansion valve(s) (410), (600), (605), and/or (935), the orifice plates (430), (620), (625), (950), and/or (955), the cold plates (440), (630), (635), (960), and/or (965) are important for isothermal control. The pressure change across other components in the flow path including the recuperator(s) (390), (580), (585), and/or (920), lines, and connections should be minimized for control purposes. In one implementation, fraction of the total pressure change between the supply stream (80) and return stream (90) pressures for the cold plate is nominally 0% to 10%, for the orifice plate is nominally 10% to 20% but may range from 0% to 45% or up to the choke flow limit), for the electronically actuated valve and integrated expansion valve is nominally greater than 50%. In some implementations, the recuperative heat exchanger, plumbing lines, and all other fittings should account for less than 10% of the total pressure change between the supply stream (80) and return stream (90).

The control module(s) (360), (550), (555), and/or (890) are used to control the flow through the cold plate module(s) (370), (560), (565), (900), and/or (905). Subcooled liquid from the supply stream (80) is sufficiently subcooled in the recuperator(s) (390), (580), (585), and/or (920), that it remains subcooled at the outlet of the electronically actuated valve(s) (400), (590), (595), and/or (930) and the outlet of the integrated expansion valve(s) (410), (600), (605), and/or (935). In one implementation, the electronically actuated valve(s) (400), (590), (595), and/or (930), are sized to provide 50% to 80% of the design flow through the cold plate module(s) (370), (560), (565), (900) and/or (905). The controller(s) either the individual controllers (360), (550), (555), and/or (890) or the single combined controller (70) actuates the electronically actuated valve(s) from closed to open per the control strategies. In one embodiment, the expansion valve(s) (410), (600), (605), and/or (935) are thermal expansion valves (TXVs) which are independently controlled, that is not controlled by controllers (360), (550), (555), and/or (890) or the single combined controller (70). In this independent TXV control configuration, the TXVs are controlled based only on feedback from their associated sensing device(s) (420), (610), (615), and/or (940) which are bellows-type devices that control the TXV valve opening position based solely on the temperature of the superheat of the fluid passing over the sensing device. The superheat detected by the sensing device determines the expansion valve position and thus flow through the valve. Alternatively, in another implementation, the sensing device and the expansion valve are mechanically, electrically, pneumatically or hydraulically linked. Other implementations including use of the one or more control modules (70), (360), (550), (555), and/or (890) to control the electrically activated expansion valve based on input from the corresponding sensing device (420), (610), (615), (940), and/or (1170).

Tuning of the integrated expansion valve sensitivity is a key feature of any control strategy. In one implementation, the expansion valve sizing, fluid internal to the bellows (not shown), and control spring (not shown) (for mechanical coupled configurations) are designed and tuned such that increasing superheat results in proportionally higher flow through the integrated expansion valve. The integrated expansion valve is tuned such that zero to ten degrees Celsius of refrigerant superheat is required at the sensing device to begin opening the integrated expansion valve. A minimum of 2° C. of superheat above the zero flow condition should be required to open the integrated expansion valve from zero flow to target flow which is the balance of the total design flow for the control module not provided by the electronically actuated rapidly acting valve (400), (590), (595) and/or (930). During periods where the cooling requirement of the cold plate assembly(s) is zero, the flowrate through the expansion valve should be less than 10% of the target flow at full cooling requirement. Should any saturated liquid refrigerant make its way back to the return flow stream, the hot gas bypass refrigerant flow (290) controlled by the activation of bypass valve (160) and be mixed into this return stream (280) to maintain a superheated refrigerant flow at the inlet to the compressor (100). For added protection an optional suction line accumulator (150) can be used.

It should also be pointed out that in the configurations discussed to date, the cold plate module(s) (370), (560), (565), (900), and/or (905) did not include their respective recuperators (390), (580), (585), and/or (920), nor did they include their respective expansion valves (410), (600), (605) and/or (935), nor did they include their respective rapidly acting control valves (400), (590), (595) and/or (930). Also, in one additional alternative implementation, the respective pressure regulating devices (380), (575), (570) and/or (910) could also be integrated into the cold plate module(s) (370), (560), (565), (900), and/or (905).

In one implementation, the pressure regulating device(s) (380), (570), and/or (910) precisely controls the refrigerant pressure upstream of the device(s), which closely corresponds to the cold plate stream (510), (750), (860), (1070), and/or (1075) pressure, and thus saturation temperature of these cold plates. The valve must be able to precisely control the stream pressure for flow rates from 0% to 150% of full flow rate. Individual control modules (360), (550), (555), (890) can be used to control each cold plate (440), (630). (635), (960), and/or (965) or a single control module (70) can individually control all these valves and provide the functional capabilities of all these separate control modules.

The cold plates (440), (630), (635), (960), and/or (965) are populated with a combination of temperature sensitive heat generating devices (450), (640), (645), (970), and/or (975) as well as non-temperature sensitive heat generating devices (455), (650), (655), (980), and/or (985). These devices are typically configured to pulse with ON/OFF cycles of at least 0.5 second. The cold plate(s) may take many forms including single component cold plates with multiple instances of a single type of heat generating device or multi-component cold plates with multiple instances of multiple types of heat generating devices. An example (not shown) is a laser amplifier unit which typically contains multiple identical laser diodes (temperature sensitive) with multiple different heat generating support components (non-temperature sensitive). The saturation temperature of the cold plate refrigerant stream(s) (510), (750), (860), (1070) and/or (1075) is controlled by the fluid pressure. In one implementation, the cold plate refrigerant stream(s) at the outlet of the cold plate is nearly completely evaporated but remains two-phase. The cold plate design requires surface temperatures under steady state (i.e. uncontrolled, continuous heat loads, steady flow) operation meet the temperature uniformity requirement.

Figure 7:
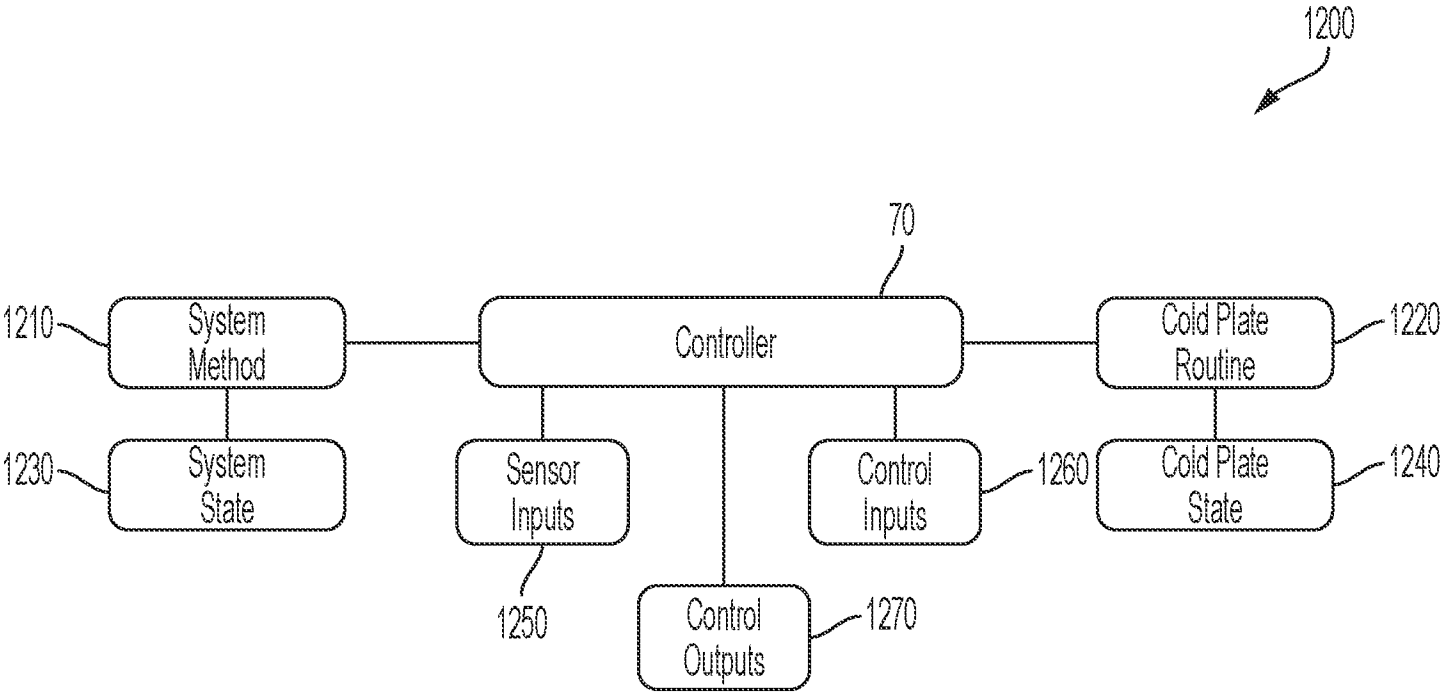
FIG. 7 shows a schematic view of the implementation of the overall control method structure with the electronic controller.

Referring to FIG. 7, in one implementation of the control method, the system control routine (1200) uses the controller (70) (such as the National Instruments cRIO 9048 via I/O modules such as NI-9381 I/O, NI-9482, CRIO-PB-MS, NI-9213, and NI-9871) or a similar controller with I/O to read sensor input signals (1250), control input signals (1260), run the system control method (1210), and the at least one cold plate assembly control method (1220) to update the control output signals (1270). The system (10) includes one or more cold plate assembly(s) (30), (40), and (50). One cold plate control routine (1220) will be used for each cold plate assembly of type (30), (40), and (50). Under certain configurations (not shown), such as multiple cold plate assemblies of identical type and identical operation, a single shared cold plate control routine (1220) can be used to control all cold plate assemblies. Sensor input signals (1250) and control input signals (1260) are used in the system control routine (1210) and the cold plate control routine (1220) to set a system state (1230) and cold plate state (1240), respectively. The controller (70) updates the control output values as determined for the specific system/cold plate state. Using the input/output functions, the controller (70) continuously reads the sensor and control input values based on sensor input signals (1250) and control input signals (1260), respectively, as well as updating the control output signals (1270) based on the control output values.

In one control implementation, all these adjustment are performed simultaneously, or so nearly simultaneous relative to the thermal response time of the system, that the result are as if they were being performed simultaneous. For example in one implementation, a complete cycle of all the adjustments is performed in less than 2 seconds, where as the thermal response of the system is far longer than 2 seconds.

In another preferred control implementation, the adjustments are performed sequentially, where the sequential order of adjustment of the valves is to adjust the one or more cold plate saturated evaporation temperature controlling outlet valves (390), (570, (575), (910) and (1140) first, then the one or more cold plate bypass valves (160), then compressor hot gas bypass valve (170) while the one or more cold plate inlet expansion valves (410), (600), (605), (935), and (1120) are continuously adjusted to control respective cold plate exit superheat.

In another preferred control implementation, the sequential order of adjustment of the valves is to adjust the compressor bypass valve (170) and the one or more cold plate bypass valves first (160) first (essentially simultaneously) and then adjust the one or more cold plate outlet valves (380), (570), (575), (910) and (1140) to control saturation pressure of the cold plates, while the one or more cold plate inlet expansion valves are continuously adjusted to control cold plate exit superheat.

Figure 8:
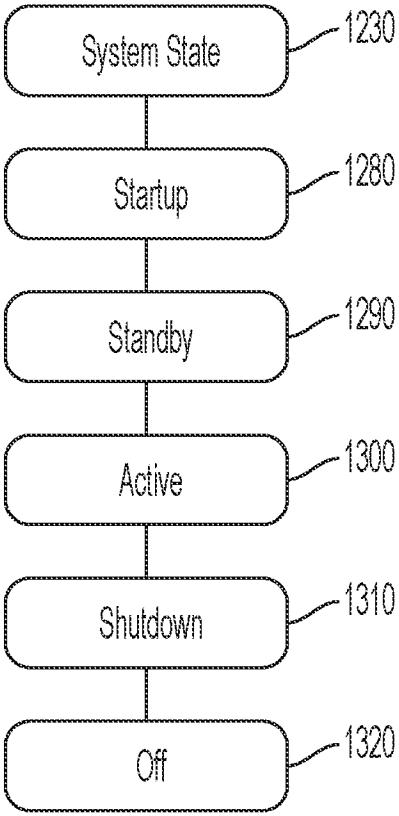
FIG. 8 shows a hierarchy of the system states.

Referring to FIG. 8, in one configuration, the System State (1230) is separated into five discrete states: Startup (1280), Standby (1290), Active (1300), Shutdown (1310), and Off (1320). The definition of these five states enables simplified discussion. Other configurations (not shown) could combine states, such as a combined standby and active state, or separate states further, such as multiple levels of Standby (1290) or Active (1300) corresponding to the number and configuration of connected cold plate assembly(s). The Off State (1320) defines the system state while the system (10) either has no power or the user has specified or controller has determined no cooling capacity is needed or will be needed. The Startup State (1280) defines the system state when the system (10) transitions from the Off State (1320) to the Standby State (1290). The Standby State (1290) defines the system state when the temperature sensitive cold plate assembly(s) (30), (40), and/or (50) do not need active transient cooling. The actual operating point of the system (10) may be from 0% to 100% of design capacity. The Active State defines the system when the temperature sensitive cold plate assembly(s) (30), (40), and/or (50) may need for active transient cooling at any time. Thus, the system (10) must be able to supply the required refrigerant at any moment. The Shutdown State (1280) defines the system state when the system (10) transitions from an Active (1300) or Standby (1290) state to the Off State (1320). Additional states that slow the transition between the described states (not shown) may be used but are not necessary.

Figure 9:
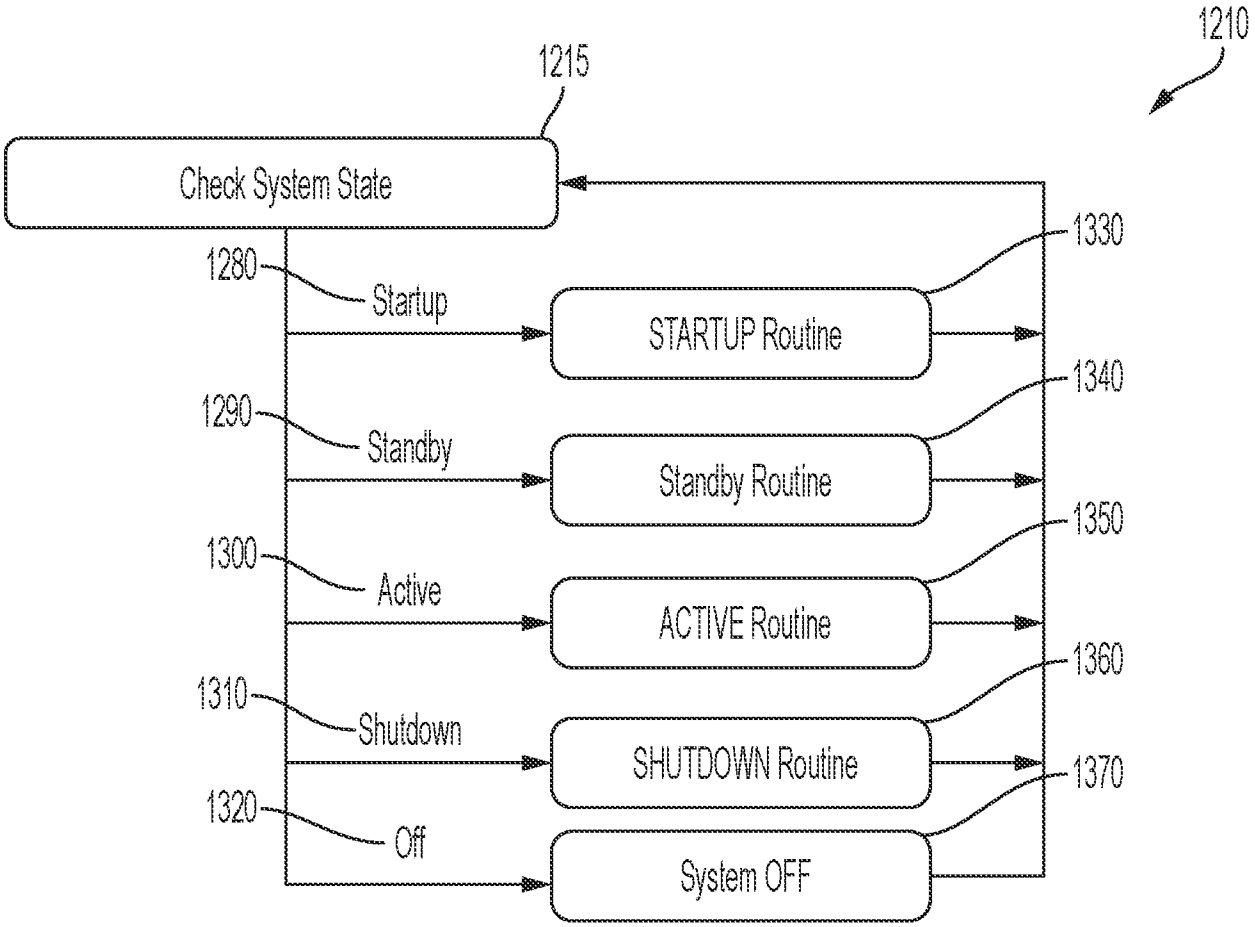
FIG. 9 shows a schematic view of the main system control method.

Referring to FIG. 9, in one implementation, the system control routine (1210) includes: a main Check System State loop (1215) that checks the system state (1230) to execute the corresponding routine. If the system state (1230) is Startup (1280), the control routine runs the Startup Routine (1330). If the system state (1230) is Standby (1290), the control routine runs the Standby Routine (1330). If the system state (1230) is Active (1300), the control routine runs the Active Routine (1330). If the system state (1230) is Shutdown (1310), the control routine runs the Shutdown Routine (1330). If the system state (1230) is Off (1320), the control routine runs the System Off Routine (1330). The actual order of the state checks can be reordered.

Figure 10:
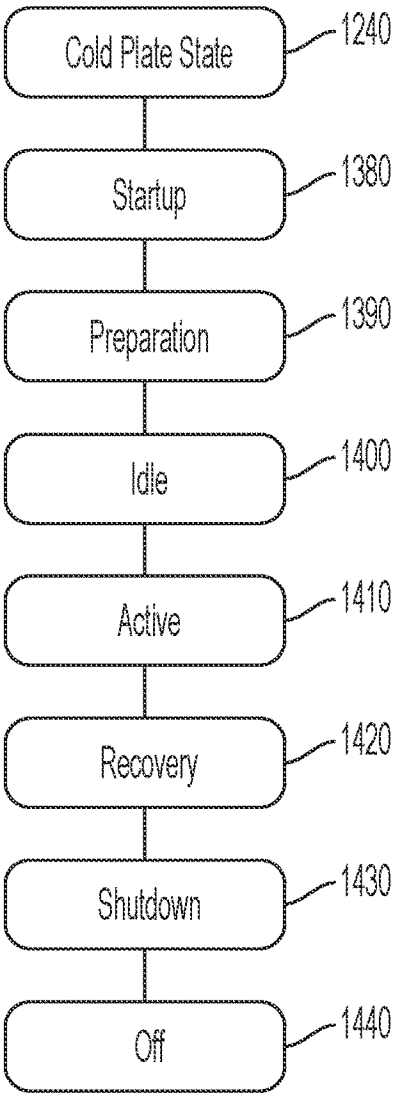
FIG. 10 shows a hierarchy of the cold plate states.

Referring to FIG. 10, in one configuration, the Cold Plate State (1240) is separated into seven discrete states, including Startup (1380), Preparation (1390), Idle (1400), Active (1410), Recovery (1420), Shutdown (1430), and Off (1440). The definition of these seven states enables simplified discussion of the cold plate assembly(s) (30), (40), and/or (50). Other configurations (not shown) could combine one or more states, such as a combined idle (1400), active (1410), and recovery (1420) states, or separate states further, such as multiple levels of Idle (1400), Active (1410) based on different levels of Control Inputs (1260). The Off State (1440) defines the cold plate state while the cold plate assembly either has no power or the user has specified or controller has determined the cold plate assembly is off or disabled. The Startup State (1380) defines the cold plate state when a cold plate assembly transitions from the Off State (1440) to the Preparation State (1390). The Preparation State (1380) defines the cold plate state while a cold plate assembly transitions from the Startup State (1380) to the Idle State (1400) and achieves the desired isothermal condition. The Idle State (1400) defines the cold plate state when the temperature sensitive heat generating components (450), (640), (645), (970), and/or (975) do not need active transient cooling but are being maintained at isothermal conditions. The Active State (1410) defines the cold plate when the temperature sensitive heat generating components (450), (640), (645), (970), and/or (975) are actively maintained isothermal through transient heat generation. The Recovery State (1420) describes the cold plate state while following a period of heat generation in Active (1410) during which the cold plate assembly is actively cooled to remove residual heat and returned to an isothermal condition. The Recovery State (1420) is used to rapidly return the cold plate assembly to an Idle State (1400) when it is known that the cold plate assembly is no longer in the Active State (1410) and the isothermal condition can be relaxed. The Shutdown State (1430) defines the cold plate state when the cold plate assembly(s) transition to the Off State (1440). Additional states that slow the transition between the described states (not shown) may be used but are not necessary. The cold plate assemblies can transition directly from the Preparation State (1390) to the Active State (1410) and remain in the active state until transitioning to the Shutdown State (1430). Using the Recovery (1420) and Idle States (1400) allows the Control Method (1200) to implement system level optimizations, such as reduce energy consumption by changing the System State (1230) to Standby (1290) or recharge the thermal energy storage device (110).

Figure 11:
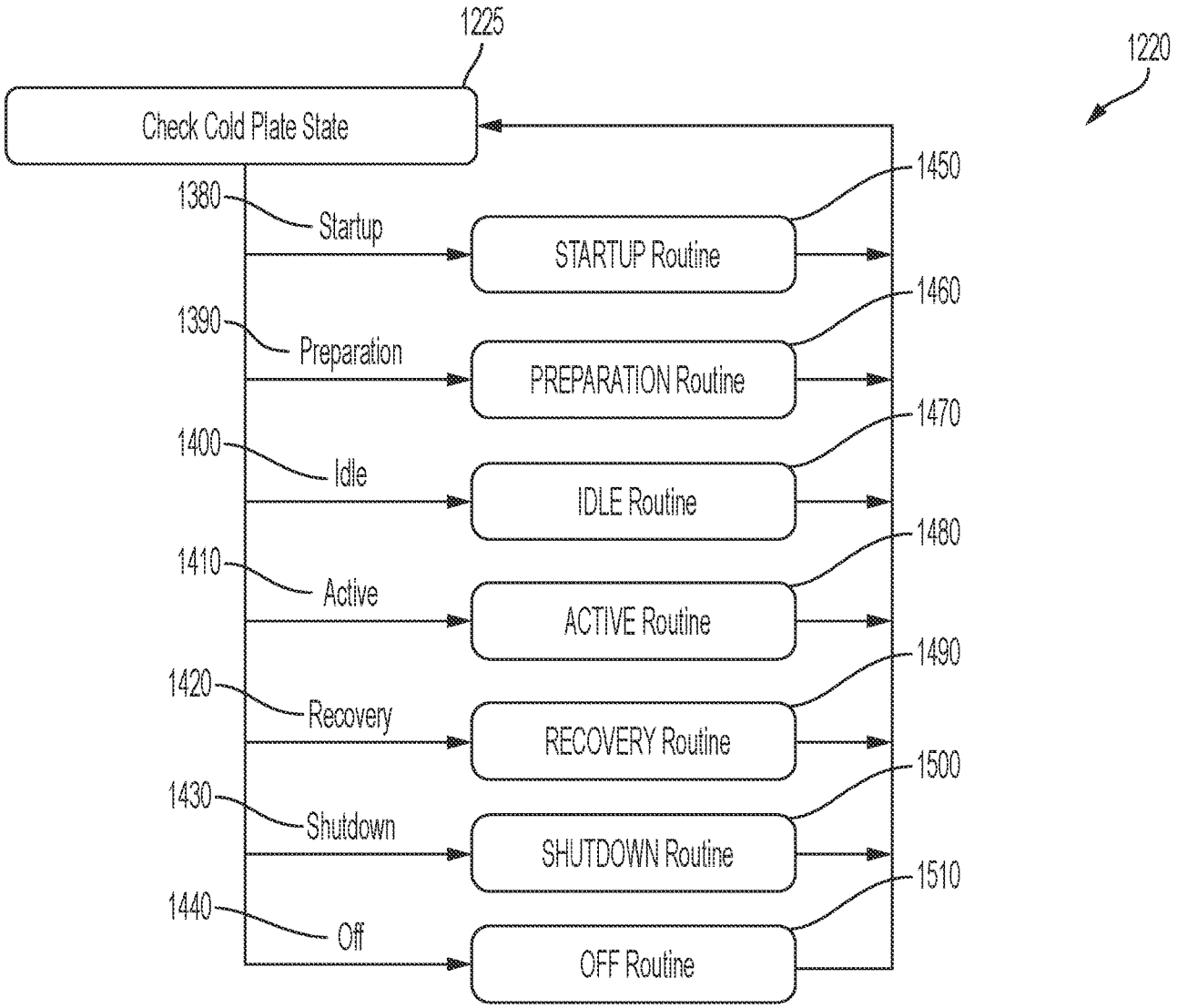
FIG. 11 shows a schematic view of the main cold plate control method.

Referring to FIG. 11, in one configuration, the cold plate control routine (1220) includes a main Check Cold Plate State loop (1225) that checks the cold plate state (1240) to execute the corresponding routine. If the cold plate state (1240) is Startup (1380), the control routine runs the Startup Routine (1450). If the cold plate state (1240) is Preparation (1390), the control routine runs the Preparation Routine (1460). If the cold plate state (1240) is Idle (1400), the control routine runs the Idle Routine (1470). If the cold plate state (1240) is Active (1410), the control routine runs the Active Routine (1480). If the cold plate state (1240) is Recovery (1420), the control routine runs the Recovery Routine (1490). If the cold plate state (1240) is Shutdown (1430), the control routine runs the Shutdown Routine (1500). If the cold plate state (1240) is Off (1440), the control routine runs the Off Routine (1510). The actual order of the state checks can be reordered.

Upon applying power to the system (10), where the system and controller are not powered, the controller sets the system state (1230) to system off (1320) and all cold plates (1240) to off (1440).

Figure 12:
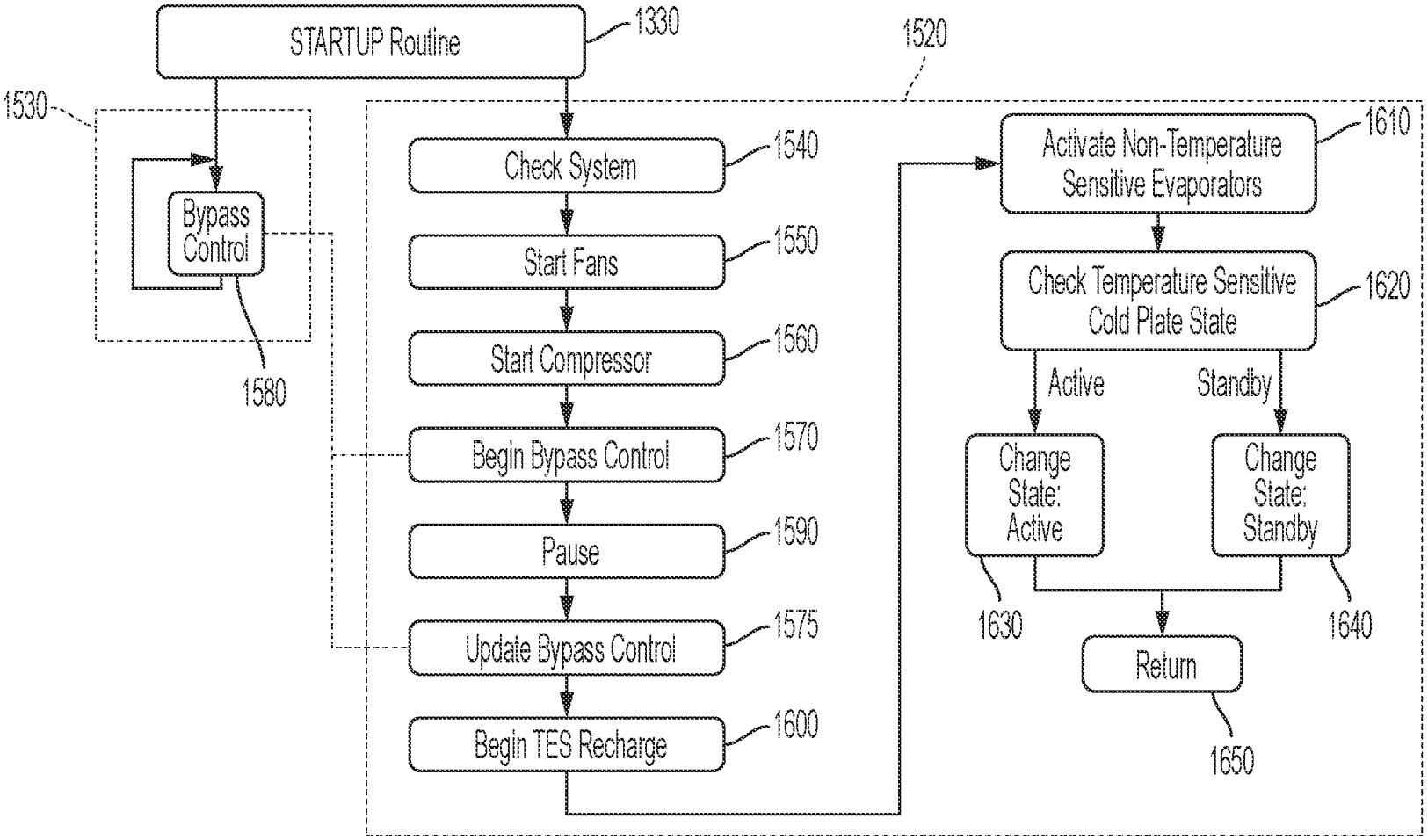
FIG. 12 shows a schematic view of the system startup routine.

Referring to FIG. 12, in one configuration, the system startup routine (1330) includes one primary sequence of tasks (1520) with a continuous control loop (1530). Using the input signals, the system configuration is checked (1540), including the number and configuration of cold plates, state of the connected cold plate assemblies, and overall health of the system (10) components. Once complete, startup of the equipment begins. Active control of the liquid bypass (160) and hot gas bypass valve (170) begins in a continuous loop (1530). The bypass control block (1580) takes signal inputs, routine inputs, and current position to set new valve positions. Initially, both valves are closed. The start fans block (1550) enables and starts the condenser fans (130) at a preset speed. Next, the start compressor block (1560) starts the compressor (100) at a preset speed. Next, the begin bypass control block (1570) sets the bypass control valve control parameters and response parameters based on the system configuration. Begin bypass control block (1570) sets the liquid bypass valve (160) position to closed and the hot gas bypass valve (170) to a fixed open position, as determined by the connected equipment. At this point, the key system components are started. A pause block (1590) permits a pause of approximately one minute to allow the system to reach a stable operating condition in which subcooled liquid is achieved at the outlet of the condenser in stream (230) and a superheated vapor is achieved at the compressor suction, stream (320). Instead of a timed pause, system parameter and stream process condition checks can be used. As the system becomes stable, the bypass control parameters are updated by update bypass control block (1575). The liquid bypass valve (160) parameters are updated to open the valve to maintain a preset compressor suction stream (320) superheat value, nominally 5 to 25° C. The hot gas bypass valve (170) parameters are updated to maintain a compressor suction stream (320) pressure. Exact value of the stream pressure is dependent on the refrigerant, compressor, cold plate assembly operating points, and placement of equipment along the return line (90) which are system dependent. Nominally, this pressure will correspond to a saturation temperature between 0 and 35° C., but may be outside this range. At this point, the system is fully operational and connected equipment can be activated, pending local control. If used, a thermal energy storage device (110) can be recharged (1600) using the evaporation of condensed liquid. Additionally, connected non-temperature sensitive optional evaporators (60) are activated. Local control on the optional evaporators (60) and thermal energy storage device (110) will modulate flow through the respective components to obtain the desired exit superheat. In the final block of the startup routine (1330), block (1620) uses inputs from the temperature sensitive cold plate assembly (30), (40), and (50) to change the system state (1230) to standby (1290) or Active (1300). If all connected temperature sensitive cold plate state(s) (1240) are off (1440), the system state (1230) is set to standby (1290). Otherwise, the system state (1230) is set to active (1300). The system startup routine (1330) is complete, calculation is returned (1650) to the main loop (1210).

Figure 13:
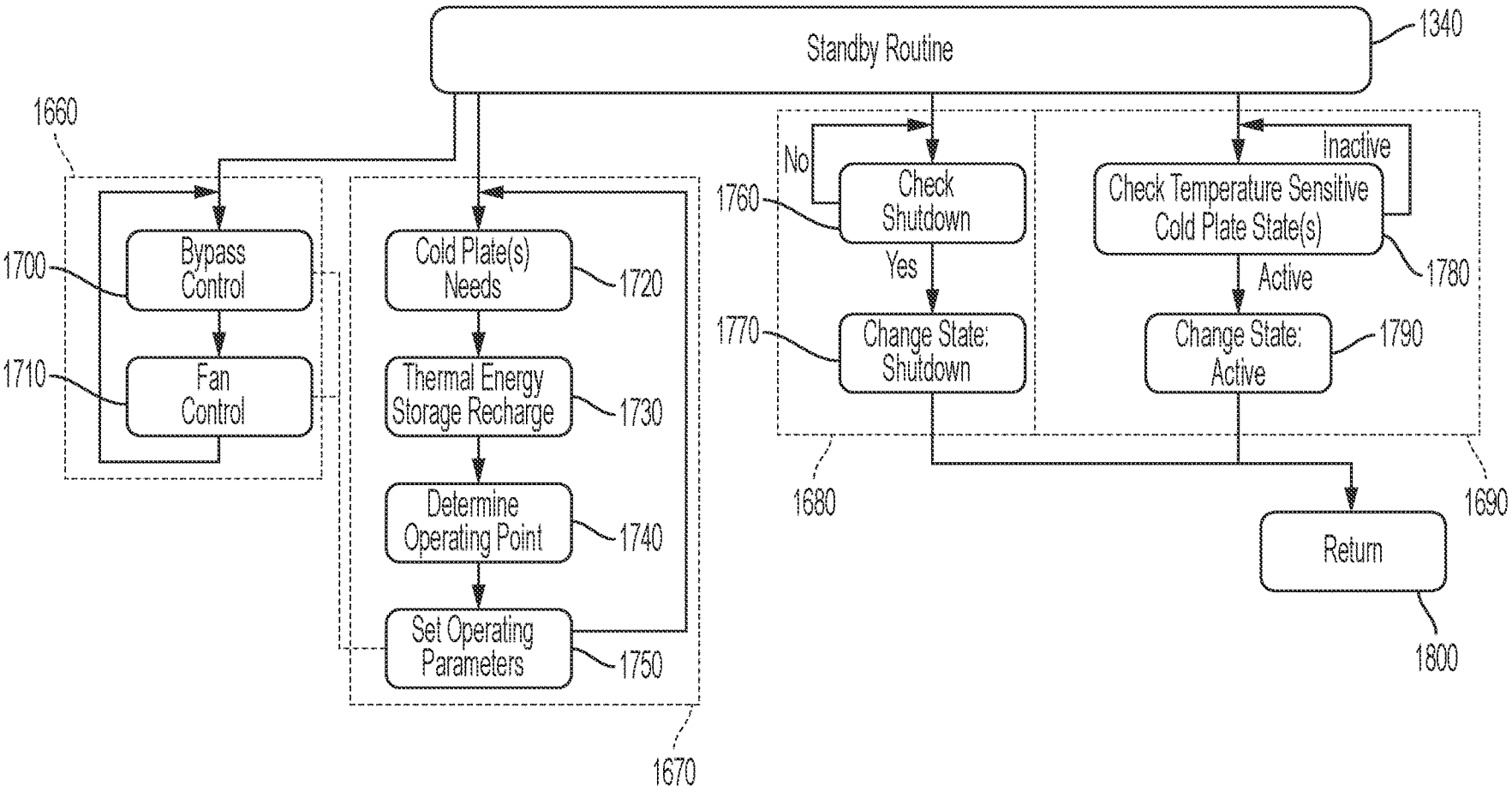
FIG. 13 shows a schematic view of the system standby routine.

Referring to FIG. 13, in one configuration, the system standby routine (1340) includes four continuous control loops: a component control loop (1660), a main standby loop (1670), a shutdown check loop (1680), and a connected cold plate state change loop (1690). Active control of the liquid bypass valve (160), hot gas bypass valve (170), and the fans (130) is maintained through the entire routine by the component control loop (1660). The component control loop (1660) begins with the set points from the previous system state (1230). The main standby loop (1670) continuously updates operating parameters based on input signals and the current system operation. The shutdown check loop (1680) and connected cold plate state change loop (1690) continuously monitor for system state (1230) and cold plate state (1240) changes or input signals or system conditions which require a state change. Check temperature sensitive state block (1780) monitors for a change in cold plate state (1240) of the temperature sensitive cold plates (30), (40), and (50) out of either the off (1440) or shutdown (1430) states indicates a temperature sensitive cold plate needs an active supply. Thus, the system state (1230) is changed to Active (1300). Check shutdown block (1760) continuously monitors for indications the system state (1230) should be changed to shutdown (1310) using a direct signal from the user, system fault, or as determined by the controller (70). If no cold plate (30), (40), (50), or evaporator (60) are connected or all are in the off state (1440), the controller (70) can signal a system shutdown. The system state (1230) is changed to a shutdown state (1310) in block (1770). If block (1770) or (1790) change the system state (1230), the program returns (1800) to the main check system loop (1215).

During the first component control loop (1660) iteration, the fan control (1710) block is switched to an active pressure set point control (if not already in this mode of control) to maintain a specified condenser (120) pressure. Fan speed is increased to decrease condenser pressure and fans speed is decreased to increase condenser pressure. Condenser (120) set point pressure is dependent on the ambient temperature and required evaporator(s) (60) supply pressures. Typically, the condenser set point pressure corresponds to a saturation temperature at least 10° C. above the ambient. However, this value is heavily dependent on the equipment (condenser (120) and compressor (100)) selection. Multiple modes of open and close loop controls can be implemented for fan control, the key being that the mode implemented is sufficient to maintain adequate condenser (120) pressure stability. In subsequent component control loop (1660) iterations, the fan control (1710) block adjusts the fan speed to maintain the pressure set point. The set point is updated by the main standby loop (1670).

During the first component control loop (1660) iteration, the bypass control block (1700) switches the bypass valve (160) and (170) control method to actively control compressor suction stream (320) process conditions. The bypass control block (1700) continuously adjusts the liquid bypass valve (160) position to maintain a compressor suction stream (320) superheat, nominally 5 to 25° C. The bypass control block (1700) continuously adjusts the hot gas bypass valve (170) position to maintain a compressor suction stream (320) pressure, which is dependent on evaporator(s) (60) operating pressure, system configuration such as return stream (90) line length or inclusion of an accumulator (150), and desired system performance such as maximize efficiency or minimize power use.

In one implementation, the main standby loop (1670) determines the capacity needs and supply and return condition requirements of non-temperature sensitive optional evaporator (60) in block (1720). The evaporator needs are determined from direct input from the optional evaporator (60), controller (70), or user, or as a function of the operating parameters. For example, rising evaporator pressure indicates the evaporator supply needed is higher than the current supply. Next, the required capacity to recharge the thermal energy storage device (110) is determined in block (1730) from input signals, such as temperature, or a calculated device state based on operational history. The required capacity and required supply (stream (80)) and return (stream (90)) conditions are used to determine the operating point in block (1740). Predetermined operating points based on compressor maps or tabulated data is used initially to set the compressor operating parameters, including speed, supply pressure, and/or discharge pressure. While not required, during operation, a closed loop feedback control monitors the system performance relative to the predetermined conditions. Small adjustments to the predetermined conditions to improve performance or efficiency are made. The compressor (100) speed parameters are set to achieve the required capacity, while minimizing power consumption. The speed is minimized subject to the minimum operating limit of the compressor. Additional input signals corresponding to ambient conditions, condenser outlet stream (230) subcooling, optional evaporator (60) pressure, bypass valve (160) and (170) positions can be used to adjust operating parameters. If a sufficiently stable evaporator (60) capacity need exists for the given components, the bypass valve parameters can be set to fully closed, as would be typical of conventional HVAC systems. Finally, output signals are updated to reflect the new operating parameters in block (1750).

Figure 14:
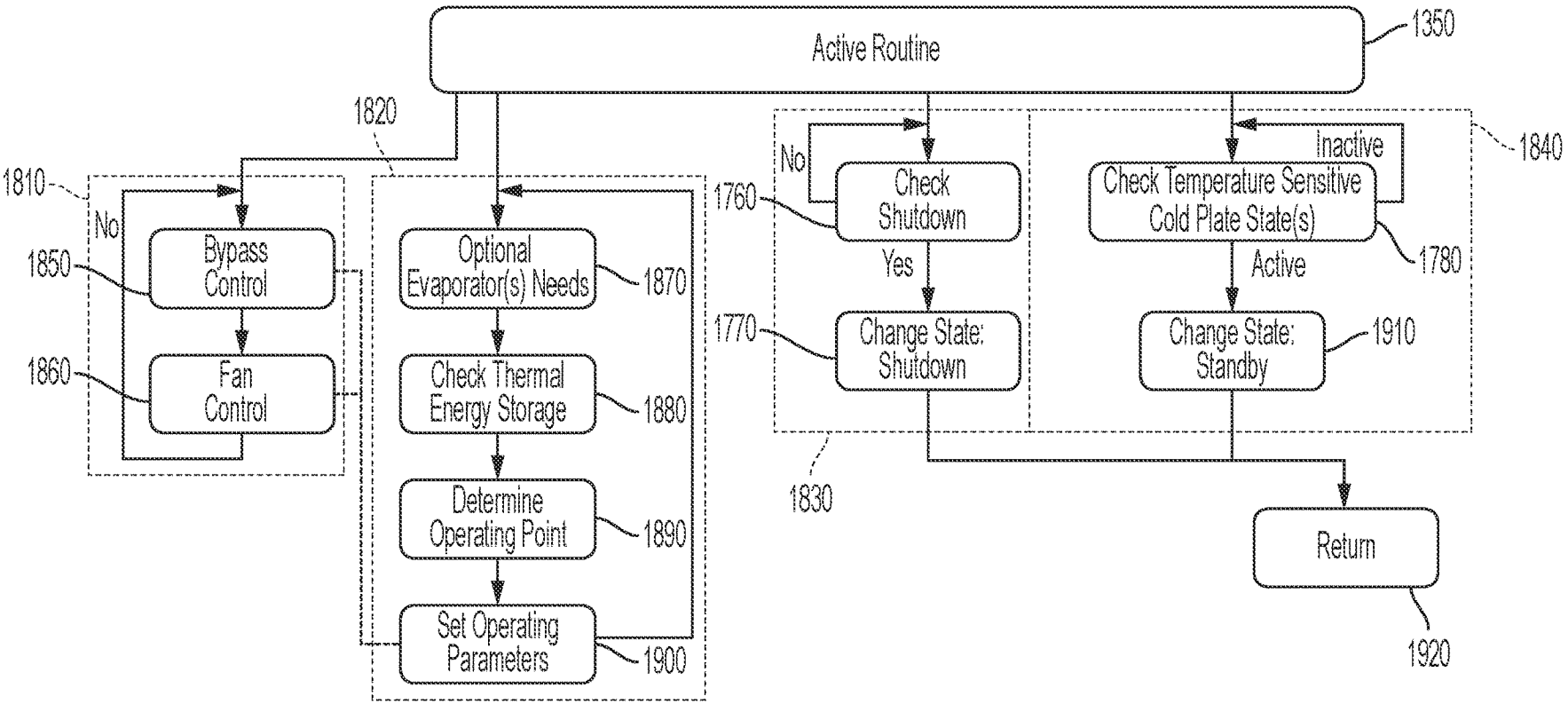
FIG. 14 shows a schematic view of the system active routine.

Referring to FIG. 14, in one implementation, the system active routine (1350) includes four continuous control loops: a component control loop (1810), a main active loop (1820), a shutdown check loop (1830), and a connected cold plate state change loop (1840). In comparison to FIG. 13, the system active routine (1350) has significant similarities to the system standby routine. The system standby routine (1340) and system active routine (1350) can easily be combined to a single routine (not shown) such that the shared blocks are combined and the operating parameters are updated based on system operating state (1230). The component control loop (1810) includes a bypass control block (1850) and fan control block (1860). The operation of the active bypass control block (1850) is identical to the standby bypass control block (1700), except the operating parameters are set based on the temperature sensitive cold plate assembly(s) (30), (40), and (50) as well as the non-temperature sensitive optional evaporator(s) (60). Additionally, under no condition in the system active state (1300) would the bypass control block (1850) set bypass valves fully closed for extended time. The operation of the active fan control block (1860) is identical to the standby fan control block (1710), except the operating parameters are set based on the temperature sensitive cold plate assembly(s) (30), (40), and (50) as well as the non-temperature sensitive cold plate(s) (60). The active shutdown check loop (1830) functions identically to the standby shutdown check loop (1680). The active connected cold plate state change loop (1840) operates similarly to the standby connected cold plate state change loop (1690). In both loops, block (1780) continuously monitors for changes in connected temperature sensitive cold plate states (1240). Change state block (1790) in loop (1690) changes the system state to active if the any temperature sensitive cold plate assembly becomes active. Change state standby block (1910) in loop (1840) changes the system state to standby if the all temperature sensitive cold plates becomes inactive. In the system active routine, if change state (shutdown) block (1770) or change state (standby) block (1910) change the system state, the program returns to the check system state routine (1215). While the blocks of the main active loop (1820) are similar to the main standby loop (1670), the functionality is significantly more extensive because the system active state (1300) requires greater interface with the temperature sensitive cold plate assemblies (30), (40), and (50), and non-temperature sensitive optional evaporators (60). Optional evaporator(s) needs block (1870) calculates the needs of non-temperature sensitive optional evaporators (60) identically to cold plate(s) needs block (1720). The needs of the temperature sensitive cold plate assemblies (30), (40), and (50) include supply and return pressures, capacities, duty cycle (if known), etc. The remaining thermal capacity of the thermal energy storage device (110) is determined in block (1880). The remaining capacity can be determined in many ways such as monitoring the outlet temperature for superheat (zero capacity remaining), internal temperature sensors that monitor the device temperature along the flow direction to calculate remaining capacity, or calculated based on known capacity and capacity used since last recharge. The system operating parameters, including compressor speed, condenser pressure, supply stream (80) conditions, return stream (90) conditions, etc., are calculated to determine operating point block (1890) to achieve the cold plate assembly needs determined in optional evaporator(s) needs block (1870). Initially, compressor tables and predetermined tables of operating points are used to set operating parameters. In the preferred embodiment, closed loop control using the input signals as measured by the controller (70) from the system (10) are used to modify the operating parameters for more precise control of the supply stream (80) and return stream (90) conditions. The system operating parameters are updated in block (1900).

Figure 15:
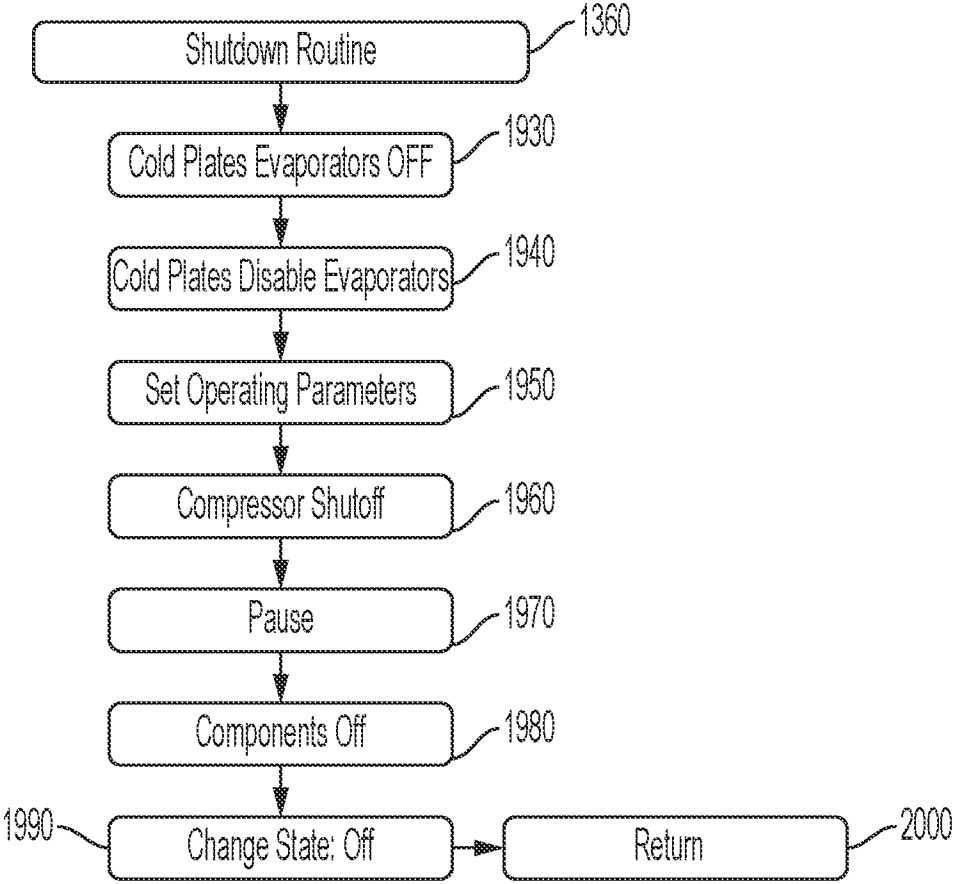
FIG. 15 shows a schematic view of the system shutdown routine.

Referring to FIG. 15, in one implementation, the system shutdown routine (1360) includes a single set of steps to safely shutdown the system. A hard stop where the system power is instantly powered down would achieve the same end state but is not ideal. The routine starts by shutting down any active cold plate assemblies or optional evaporators in evaporators OFF block (1930). All cold plate assemblies or optional evaporators are set to the shutdown state (1430), if not already set to the off state (1440). Once all cold plate assemblies—and evaporators are in the off state (1440), the controls for the cold plate assemblies—and evaporators are disabled in disable evaporators block (1940) which prevents any cold plate assembly—or evaporator from being enabled. To this point, the bypass and fan loops have maintained operation from the active loop. Set operating parameters block (1950) sets the fan speed to a high speed to rapidly cool the condenser. In the preferred embodiment the fan speed is set to 100%. Any fan condition sufficient to provide cooling beyond the compressor heat addition is sufficient but will result in longer shutdown times. With the fans operating at or near full speed, the bypass valves are slowly closed to reduce bypass flows. As a result of the updated operating parameters, the system pressures decrease. Compressor shutoff block (1960) monitors the system pressures for minimum operating pressures. Once the minimum operating pressure is reached, the compressor is turned off and bypass valves (160) and (170) completely closed (if not already closed). This is followed by a pause (1970) of approximately 30 seconds to allow the condenser to cool. The fans continue to operate at the operating point set in set operating parameters block (1950) during this time. An alternate fan speed can be set during the pause. After the pause (1970) is complete, all the components of the system (10) are turned to their respective off states in components off block (1980). Once all components are in their off states, the system state (1230) is changed to system off (1320) in change state off block (1990). The shutdown routine is now complete, the program is returned (2000) to the check system state (1215) loop.

Figure 16:
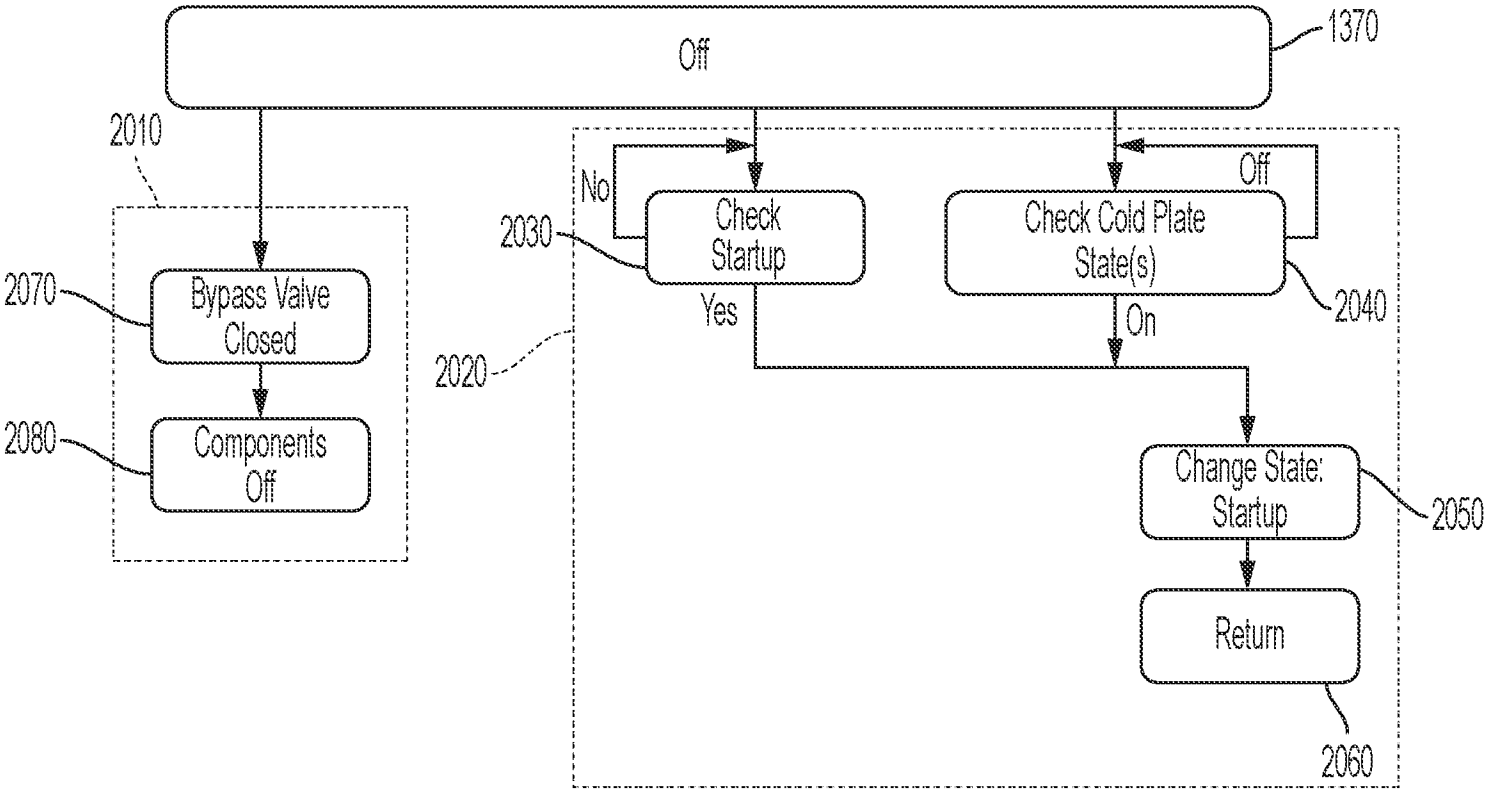
FIG. 16 shows a schematic view of the system off routine.

Referring to FIG. 16, in one implementation, the system off routine (1370) includes two parallel subroutines: a shutdown routine (2010) and a system activate loop (2020). The shutdown subroutine (2010) is not required in most cases where the system is properly shutdown using the system shutdown routine (1360). However, in cases such as system faults or improper shutdown, these blocks are required. Bypass valve closed block (2070) closes the bypass valves (160) and (170). Components off block (2080) sets all cold plate assemblies and evaporators to off (1440) and turns all system (10) components to their respective off states. The system activate loop (2020) checks for system startup signals in check start up block (2030) and for cold plate activate signals in check cold plate state block (2040). If either block (2030) or (2040) identifies a system startup condition exists, the system state (1230) is changed to startup (1280). The program is returned (2060) to the main check system state (1215) loop.

This completes the system control routine. Next, the cold plate control routine (1220) will be described. In a system (10) with multiple temperature sensitive cold plate assemblies (30), (40), and (50), the cold plate control routine (1220) is applied to each temperature sensitive cold plate assembly separately.

Figure 17:
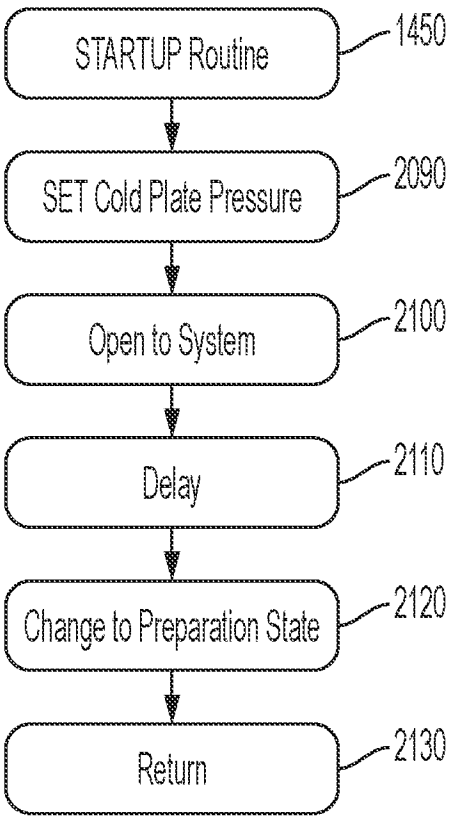
FIG. 17 shows a schematic view of the cold plate startup routine.

Referring to FIG. 17, in one implementation, the startup routine (1450) prepares the cold plate assembly for operation while minimizing transient conditions. In set cold plate pressure block (2090), the cold plate pressure is set as predetermined ($P_{uniform}$) for the application. The set point pressure corresponds to the desired cold plate saturated evaporating temperature and thus to the desired cold plate surface temperature. The pressure regulating devices (380), (570), or (910) controlled ideally be the single control module (70) controls the cold plate stream (510), (750), (860), (1070), or (1075) pressure. In another embodiment, individual control modules (360), (550), (555) and (890) could be used. Open- or closed-loop control routines can be implemented to maintain the cold plate saturated refrigerant stream pressure and thereby the saturation temperature. Cold plate stream pressure can be directly measured, measured indirectly from an upstream or downstream fluid location, or inferred through temperature measurement. Once the pressure is set, the cold plate assembly is opened to the supply (80) and return streams (90) by opening the pressure regulating device in open to system block (2100). Refrigerant flow entering the cold plate modules (370), (560), (565), (900), and (905) is controlled by the control module. The refrigerant flow will be nominally trend to zero and remain at zero once the cold plate is opened to the supply (80) and return streams (90) and the cold plate thermally equilibrates and no heat load is applied to the cold plate. To allow the equilibration to occur, a short delay is used. This delay is dependent on the thermal mass of the cold plate assembly and can be as short as 1 second but was found to be 10 to 15 seconds for the system tested. Longer may be required for high mass systems. After the delay, the cold plate state (1240) is changed to preparation (1460) in change to preparation state block (2120) and the program is returned (2130) to the check cold plate state loop (1225).

Figure 18:
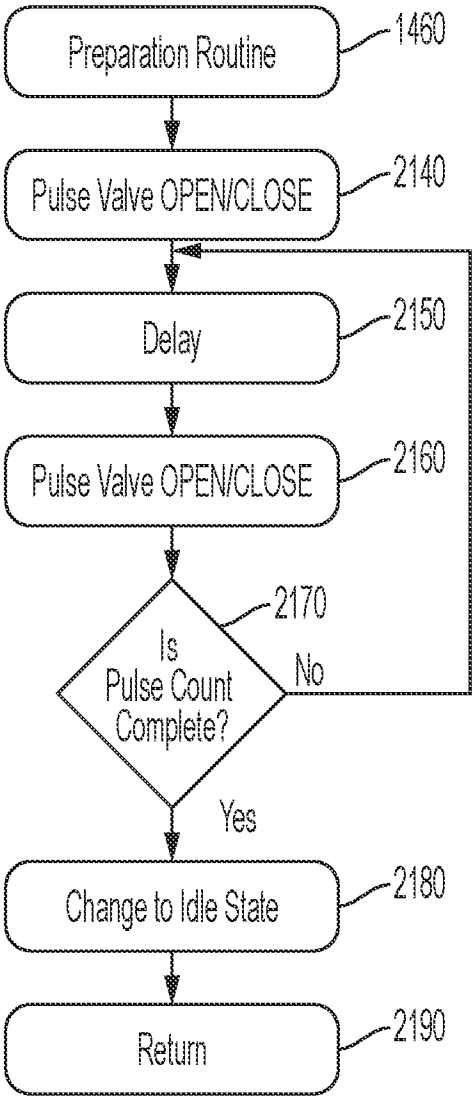
FIG. 18 shows a schematic view of the cold plate assembly preparation routine.

Referring to FIG. 18, in one implementation, the preparation routine (1460) brings the cold plates into a steady isothermal condition. With the cold plates already operating at the operating pressure corresponding to the isothermal state, the cold plate module (370), (560), (565), (900), and (905) is actively cooled. The electronically actuated valve in the control module (360), (550), (555), and (890) is pulsed in a predetermined timed sequence of valve OPEN/CLOSED intervals to allow refrigerant to flood the cold plate. The time intervals may depend on measured cold plate temperature, ambient temperature and humidity, cold plate thermal mass, or input signal. The electronically actuated valve is opened, maintained opened for a predetermined time, and closed in block (2140). A valve OPEN duration between 0.3 and 3 times is the average liquid transit time through the cold plate module. A delay (2150), while the valve is CLOSED, is nominally 10 to 100 times the valve OPEN duration. After completing the delay (2150), the valve is pulsed (2160) open, maintained open for a short duration, and closed. The duration of the valve OPEN is typically identical to the first pulse (2140) but may differ slightly and will depend on the thermal response of the cold plate module. At the completion of the second pulse and each subsequent pulse, the pulse count is compared to a predetermined maximum count determined for the specific system in block (2170). If the pulse count has not been reached, the delay (2150) followed by a pulse (2160) is repeated until the pulse count is reached. At which point, the program would change the cold plate state (1240) to idle (1400) in block (2180) and return (2190) to the check cold plate state (1225) loop. In the preferred embodiment, this sequence is repeated for up to 15 minutes. For example, a valve OPEN duration of 5 seconds is 1.25× for a cold plate with a liquid velocity of 0.25 m/s and an average flow path length of 1 m. A valve CLOSED duration of 150 seconds would be 30 times the valve OPEN duration. A total of 11 pulses would occur, totaling just under 15 minutes duration. In many systems, the cold plates will reach steady isothermal conditions well before 15 minutes. Thus, fewer pulses would be required. In low ambient temperature environments, the controller (70) may require heat to maintain reach steady isothermal conditions. In this condition, the preparation routine (1460) may call (not shown) for the heat generating components to provide heat to the cold plate module.

Figure 19:
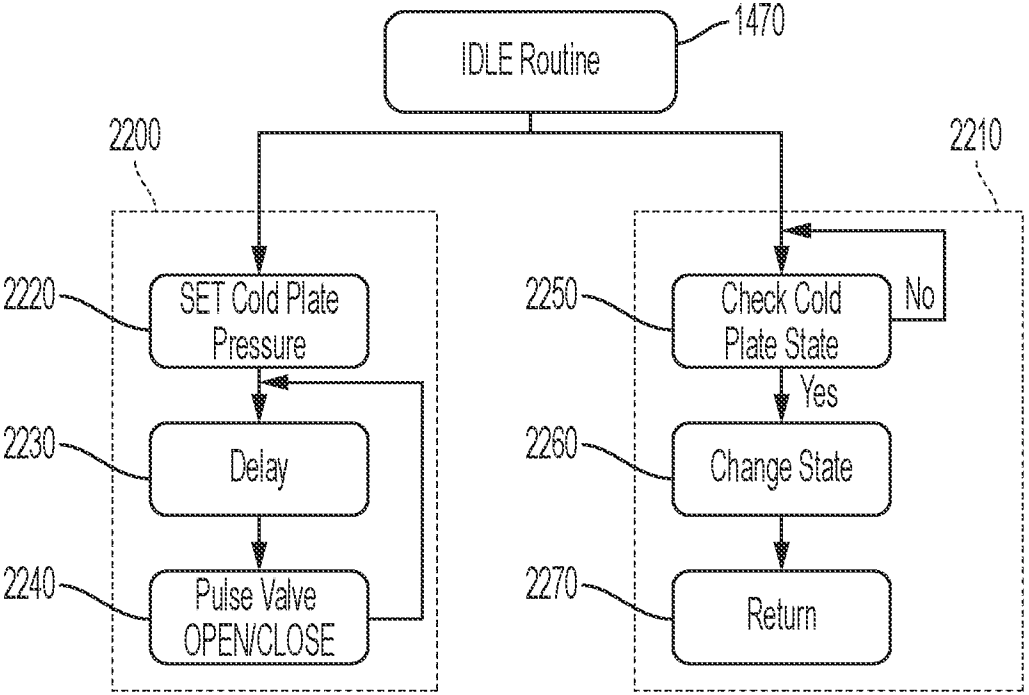
FIG. 19 shows a schematic view of the cold plate assembly idle routine.

Referring to FIG. 19, the idle routine (1470) maintains the cold plates at a steady isothermal condition. The routine is divided into two loops, a maintain isothermal conditions loop (2200) and a check cold plate state loop (2210). The maintain isothermal conditions loop (2200) adjusts the pressure regulating device (380), (570), or (910) controlled by the electronic controller (70) to maintain the cold plate stream pressure at $P_{uniform}$ in module (2220). The controller (70) may adjust the value of $P_{uniform}$ as operational conditions or device modes (not shown), which depend on the system specific design. In most cases, the cold plate will already be at this pressure and $P_{uniform}$ will remain constant.

In one implementation, in addition to the <10% of flow through the cold plate as set by tuning the integrated expansion valve (410), (600), (605), and (935), the electronically actuated valve (400), (590), (595), and (930), is pulsed OPEN/CLOSED in a similar sequence with a pause between pulses as preparation routine (1460) to provide additional refrigerant flow to maintain the cold plate in an isothermal condition. The pulse intervals in the maintain isothermal conditions loop (2200) may depend on measured cold plate temperature, ambient temperature and humidity, cold plate module design (thermal mass) or other input signal and may continuously vary. The valve CLOSED duration will nominally be 10 to 200 times the valve OPEN duration. The maintain isothermal conditions loop (2200) sequence starts with a delay to the first pulse from entering the idle routine (1470), which can be zero seconds. A valve OPEN duration between 0.3 and 3 times the average liquid transit time through the cold plate module. This sequence is repeated indefinitely while in the idle state (1400).

Concurrently, in one implementation, the change state loop (2210) is continuously checking for a change in cold plate state (1240) in block (2250). A state change can come directly from a user input signal to change the cold plate state or as an interpreted change in state based on the operating mode of the temperature sensitive heat generating components (450), (640), (645), (970), or (975). For example, initiation of a tracking method, targeting method, or other preparation method or switching to a ready condition in which a HEAT PULSE can initiate at any time could indicate a change to an active state (1410). Here a HEAT PULSE is any event which causes the heat generating components to generate heat which must be removed by the system (10) and is typically transient in nature. Additionally, a power down of all heat generating components could indicate a state change to shutdown (1430). Once a state change is identified, the state is changed in block (2260). The program is then returned to (2270) to the main check cold plate state (1225) loop. In low ambient temperature environments, the controller (70) may require heat to maintain isothermality while idling. In this condition, the idle routine (1470) may call (not shown) for the heat generating components to provide heat to the cold plate module.

Figure 20:
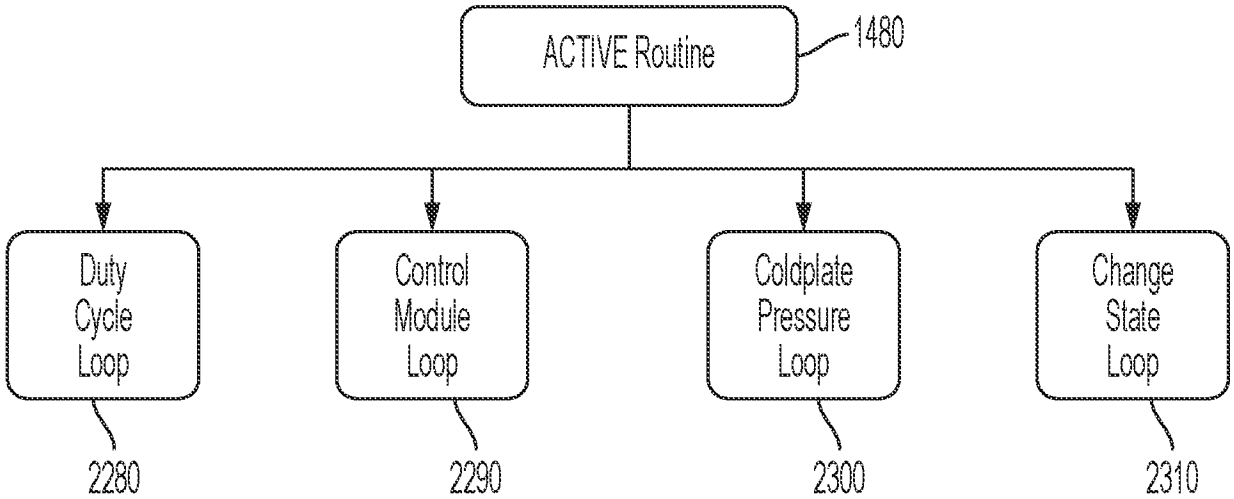
FIG. 20 shows a schematic view of the cold plate assembly active routine.

Referring to FIG. 20, in one implementation, the active routine (1480) controls the cold plate while the heat generating components require active isothermal control. The routine includes four parallel loops which operate continuously: a calculate duty cycle loop (2280), a control module loop (2290), a cold plate stream pressure loop (2300), and a change state loop (2310).

Figure 21:
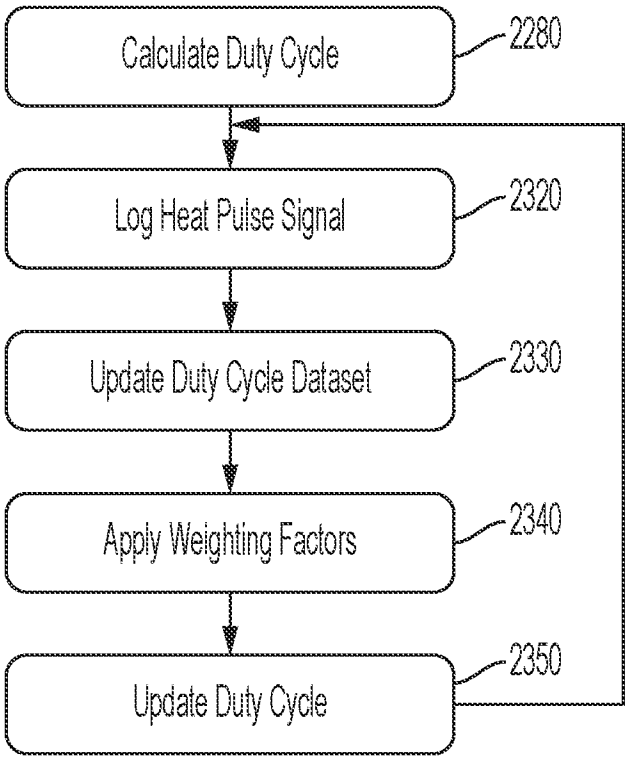
FIG. 21 shows a schematic view of the cold plate assembly calculate duty cycle loop.

Referring to FIG. 21, in one implementation, the calculate duty cycle loop (2280) calculates a weighted factor based on the fraction of time the heat generating components heat generating components (450), (640), (645), (970), (975), (455), (650), (655), (980), and (985) are ON as a fraction of total time. In the preferred embodiment, the HEAT PULSE signal (not shown) is provided by the heat generating device(s) to the controller (70). If direct signal is not available, the HEAT PULSE signal can also be user input or controlled by an alternate signal including power draw or the heat load device, cold plate surface temperature, a measure of the resulting heat load output such as laser optical power, or other signal. The DUTY CYCLE is calculated by the controller (70) at a frequency at least equal to the shortest ON or OFF time of the heat generating components. The controller begins to log the HEAT PULSE signal in block (2320), indicating the heat generating components are ON, at the start of the cold plate entering the active state (1410). A retroactive log of HEAT PULSE OFF data can be entered in the first iteration to account for the time in idle. The use of a retroactive signal is dependent on the weighting method selected in block (2340). The duty cycle data set is updated in block (2330). Here, the earliest data may be deleted if a finite window of data is used. If a continuous window is selected, the new data is appended to the end of the existing data set. In block (2340) a weighting factor is applied to calculate a single value representative of the heat load applied to the cold plate from the heat generating components. The Duty Cycle Dataset can be calculated as: 1) a long-term average from the time of entering the active state (1410), or time of first HEAT PULSE, or other event, 2) a moving average over a fixed time window, 3) a last-in first-out window average over a fixed time window, 4) a window function weighted average over a fixed time window where the weighting window can be a rectangular, B-spline, or other polynomial, a sine window, a cosine-sum window such as a Hann or Blackman window, an adjustable window such as the Tukey window, or similar weighting function. Finally, the time based array of weighted or unweighted Duty Cycle Dataset is combined to a single DUTY CYCLE value in block (2350). This value is provided to the other loops in the active routine (1480).

Figure 22:
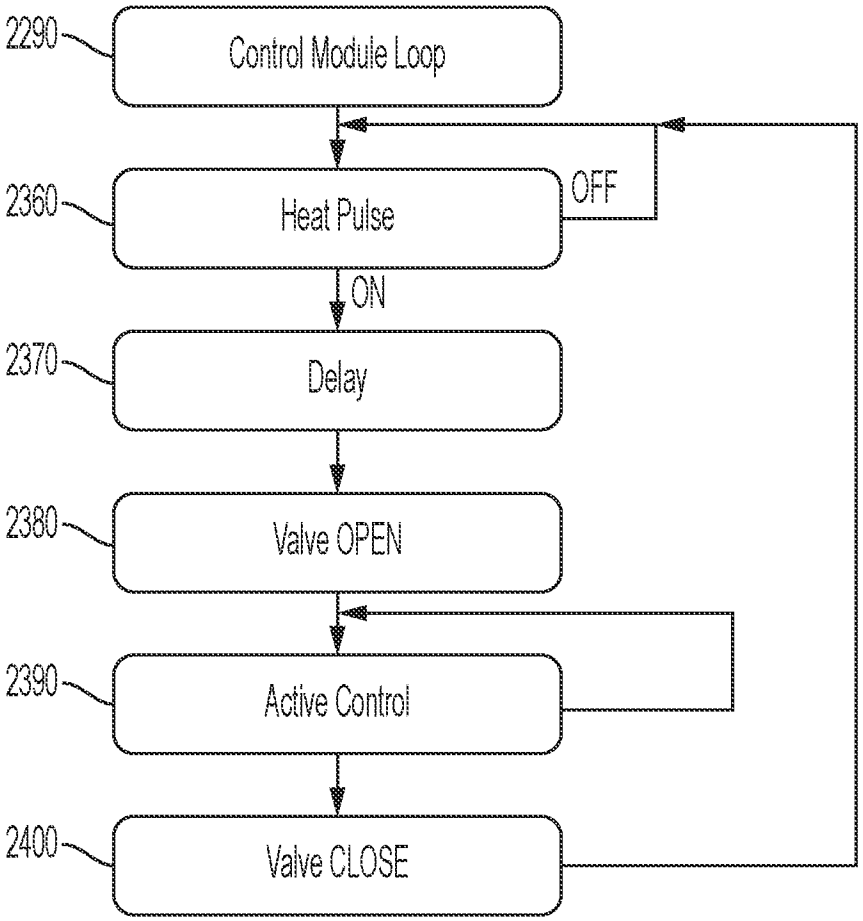
FIG. 22 shows a schematic view of the cold plate assembly control module loop.

Referring to FIG. 22, in one implementation, the Control Module Loop (2290) actively controls the electronically actuated valves (400), (590), (595), and (930) in the control modules (360), (550), (555), and (890). The control of this valve is used to generate a positive flow through the cold plate modules (370), (560), (565), (900), and (905) such that the integrated expansion valves (410), (600), (605), and (935) is able to react to superheat with minimal lag after the HEAT PULSE is initiated. In the active state (1410), the Control Module Loop (2290) is automatically started. Block (2360) begins to monitor for a HEAT PULSE. The control loop takes no action until the first HEAT PULSE is initiated. Once a HEAT PULSE is initiated, a delay timer (2370) of zero to 10 seconds is initiated. The exact time is dependent on the thermal mass of the cold plate modules and heat generating components. Lower thermal mass means a shorter delay is required. A delay of zero seconds can always be used but may result in lower system efficiency and a wider cold plate surface temperature range. After the delay timer (2370) is complete, the electronically-actuated valve is OPENED in block (2380) for a predetermined duration at least as long as the liquid transit time through the cold plate. Once the electronically actuated valve OPEN delay timer is complete, the electronically actuated valve control begins an active control block (2390) which may be dependent on the DUTY CYCLE, set to maintain the valve OPEN continuously, or in a predefined pattern. Active control block (2390) is maintained until it is determined the electronically actuated valve can be turned off in block (2400) following long time periods without a HEAT PULSE or when the DUTY CYCLE drops below a predefined value. A predefined DUTY CYCLE cutoff value may be set to less than 50% or the percentage of flow designed to be provided by the electronically actuated valve. A time period should be at least as long as the liquid transit time through the cold plate module. Thermal mass of the cold plate module will lengthen the time period and lower the DUTY CYCLE cutoff value. Once the program is in the valve close block (2400), the program begins to look for a new first HEAT PULSE. During extended HEAT PULSE OFF signals, a predetermined timed sequence of valve OPEN/CLOSED intervals of the electronically actuated valve can assist in maintaining an isothermal cold plate surface temperature. Short electronically actuated valve ON cycles during a long heat pulse OFF signal, similar to the behavior in the idle routine (1470), can assist in maintaining cold plate surface isothermality.

Figure 23:
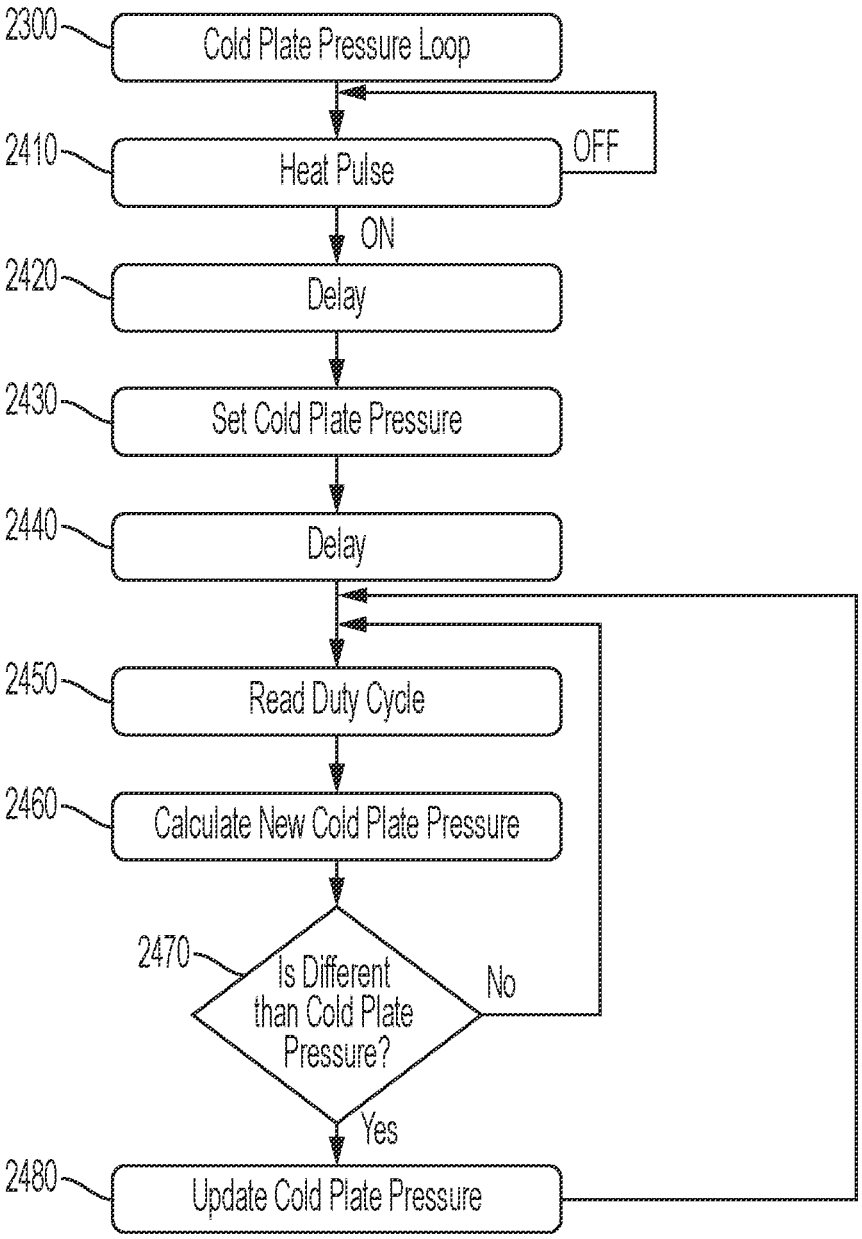
FIG. 23 shows a schematic view of the cold plate assembly pressure loop.

Referring to FIG. 23, in one implementation, the Cold Plate Pressure Loop (2300) actively controls the pressure regulating devices (380), (570), and (910) to modulate the cold plate stream (510), (750), (860), (1070), and (1075) pressure. The actual pressure set points are dependent on the cold plate assembly design and the heat generating component specifications, such as heat flux and target operating temperature. The internal heat transfer characteristics of the cold plate greatly affect the temperature difference between the refrigerant and the cold plate. As heat is applied and/or the heat flux is increased and/or the duty cycle increases, this temperature difference increases which requires an active decrease in the cold plate pressure from the no heat load isothermal pressure $P_{uniform}$. In the active state (1410), the Cold plate Pressure Loop (2300) is automatically started. Block (2410) begins to monitor for a HEAT PULSE. The Cold Plate Pressure Loop takes no action until the first HEAT PULSE is initiated. Once a HEAT PULSE is initiated, a delay timer (2420) of zero to 20 seconds is initiated. The exact time is dependent on the thermal mass of the cold plate assembly and heat generating components but for most conditions a predetermined time delay is equal to the liquid transit time or less. During this delay, the pressure regulating device set point is maintained at the starting pressure. Following the delay (2420), the pressure regulating device set point is decreased to a predetermined pressure for a predetermined time between 0.5× and 10× the liquid transit time in block (2430). The pressure set point is between the starting pressure and the minimum pressure at 100% duty cycle or steady state operation where the temperature difference between the refrigerant and the cold plate is greatest. Next, a second delay timer (2440) between 0.5× and 10× the liquid transit time is initiated. For DUTY CYCLES during the initial period below 80%, the predetermined time of this control step may be shortened to prevent over cooling of the cold plate module. After the completion of this delay (2440), the pressure regulating device set point becomes fully dependent on the DUTY CYCLE. For known HEAT PULSE patterns, the DUTY CYCLE is known a priori, thus a predefined set point pattern could be used. The pressure regulating device set point is controlled between a minimum pressure (at 100% duty cycle) and a maximum pressure (at 0% duty cycle). A linear, polynomial, segmented, stepped, or similar function with respect to DUTY CYCLE determines the interpolated pressure set point. At each time step, the DUTY CYCLE is read (2450) and a new pressure regulating device set point is calculated (2460). The pressure regulating device set point are recalculated at the same frequency as the PULSE signal logging and DUTY CYCLE calculation. In one implementation, it was discovered that updating the pressure regulating device set point at each interval when the resulting change in set point is small is not required and may prevent the control method from achieving cold plate surface isothermality. Thus, a pressure change threshold value equivalent to a 10% change of DUTY CYCLE or less may be used and the corresponding pressure regulating device set point is calculated in block (2470). The pressure regulating device set point is only updated in block (2480) when the new calculated set point differs from the current pressure regulating device set point by greater than the threshold value.

Figure 24:
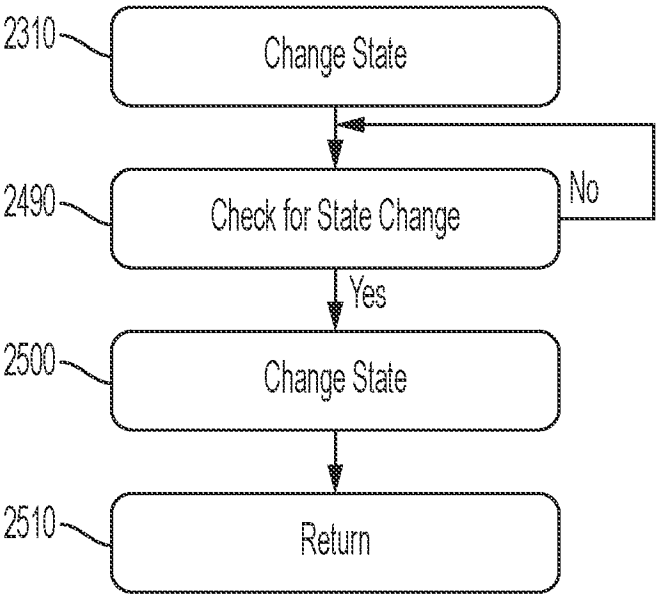
FIG. 24 shows a schematic view of the cold plate assembly change state loop.

Referring to FIG. 24, in one implementation, the Change State Loop (2310) actively checks for a change in cold plate state in block (2490) continuously while in the active routine (1480). A state change can result from a user input or input from the heat generating components indicating a state change such as change in state, power condition, or an alert state indicating the heat generating components will not generate a HEAT PULSE for some sufficiently long period of time. One possible condition is from high energy lasers which have a finite active period, after this period, the fiber laser modules go into a recovery mode for a set period of time. In parallel, the system cold plate state would ideally go into a recovery state (1420). Many similar conditions exist and are dependent on the heat generating components of the specific cold plate. When a state change event is determined, the cold plate state (1240) is changed in block (2500) and the program is returned (2510) to the main check cold state loop (1225).

Figure 25:
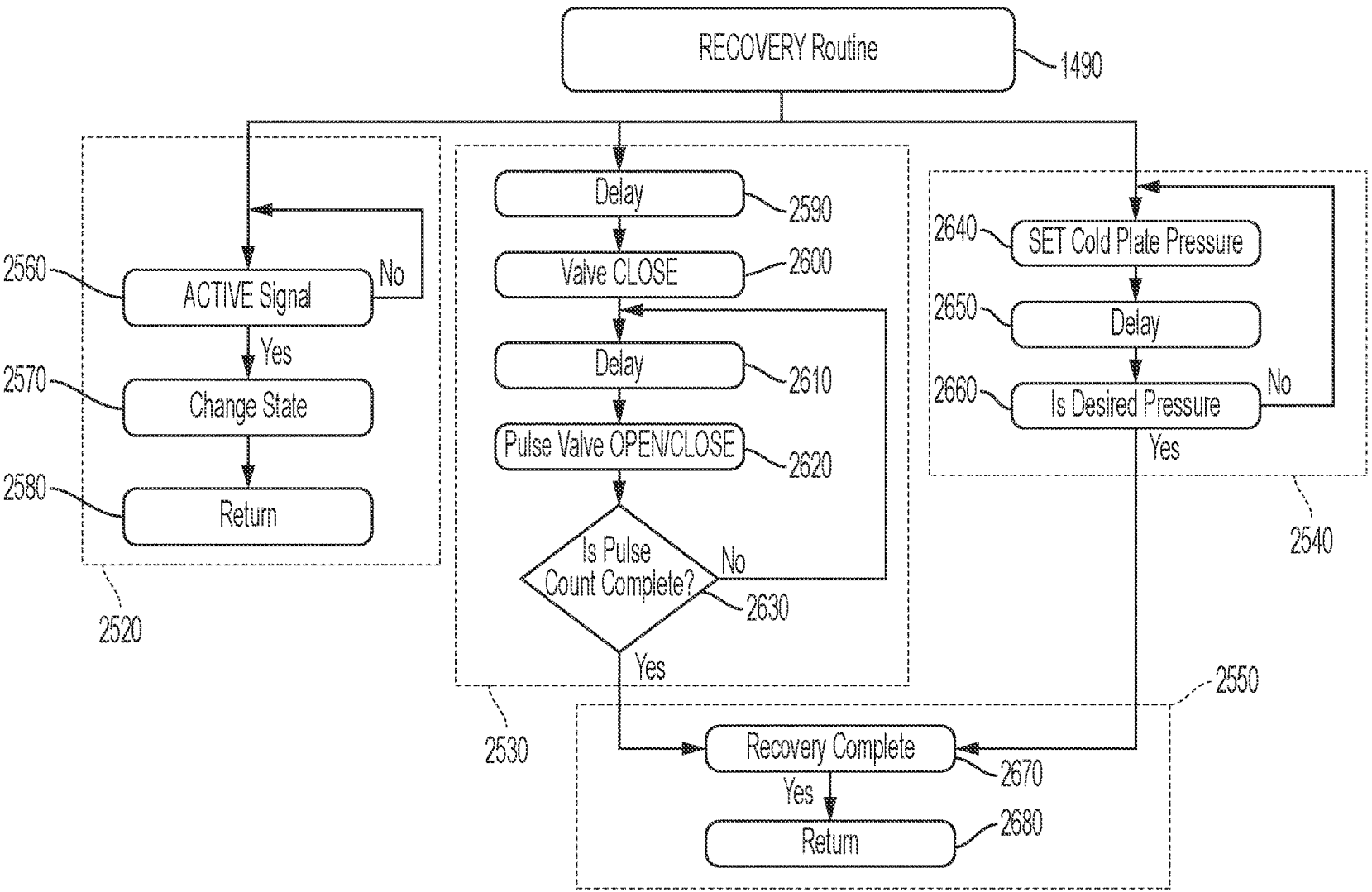
FIG. 25 shows a schematic view of the cold plate assembly recovery routine.

Referring to FIG. 25, in one implementation, the recovery routine (1490) actively brings the cold plate back to an isothermal condition and removes residual heat from the cold plate module following an active state (1410). During this routine, the cold plate modules may exceed the isothermal conditions for short periods of time which is allowable based on the inactive state of the heat generating components. The recovery routine (1490) consists of three simultaneously executed loops: a change state loop (2520), a control module loop (2530), and cold plate pressure control loop (2540). To complete the recovery sequence, the control module loop (2530) and cold plate pressure control loop (2540) must be complete, which is monitored by the recovery complete check module (2550). The recovery routine (1490) is essentially an extension of the active routine (1480). As such, there is a significant probability the heat generating components may quickly switch back to an active state. Thus, the change state loop (2520) continuously looks for a changed state of the cold plate or indications the cold plate state should change in block (2560). If a change state signal is found, the state is changed in block (2570) and the program is returned the program is returned (2580) to the main check cold plate state loop (1225). Most commonly this would be back to the active state (1410) or to a shutdown state (1430). The control module loop begins with a timed pause (2590) of 0 to 30 seconds, during this time the electronically actuated valves (400), (590), (595), and (930) in the control modules (360), (550), (555), and (890) are maintained in their prior state, most likely OPEN. After the delay (2590) is complete, the electronically actuated valve is closed (2600) and a new predetermined delay (2610) is initiated. This delay is dependent on the exact cold plate configuration but is nominally between 3 and 600 times the liquid transit time through the cold plate. This begins a loop of electronically actuated valve OPEN/CLOSED pulses (2620) where a valve OPEN duration between 0.3 and 3 times the average liquid transit time through the cold plate follows the delay (2610) where the valve is CLOSED for a duration of 10 to 200 times the valve OPEN duration. The OPEN and CLOSED durations may change with each loop. This loop is repeated for a predetermined count or until the cold plate module reaches a predefined state based on temperature and pressure conditions. The number of cycles will depend on the length of the OPEN and CLOSED durations and the allowable recovery time for the heat generating components. The total time should be minimized for a given system but can be up to approximately 90% of the allowable recovery time. In addition to pulsing liquid refrigerant through the cold plate module to return to an isothermal condition, the pressure must also be returned to $P_{uniform}$. In the cold plate pressure loop (2540), a timed increase in the pressure regulating device (380), (570), and (910) setpoint from the starting setpoint up to $P_{uniform}$ is executed starting with a step up in pressure (2640), followed by a timed delay (2650). The pressure step may decrease with each loop where the initial steps are large and the final steps are small. The total time should be equal to or shorter than the length of the control module loop (2530). The step size and the delay are heavily dependent on the cold plates and evaporator configuration and duty cycle at entering the Recovery routine (1490). A high thermal mass will retain more heat and require a longer time to return to $P_{uniform}$. The cold plate pressure should track with the excess thermal energy in the cold plate. Where highest excess thermal energy equates to the lowest pressure. The highest excess thermal energy would occur immediately following a 100% DUTY CYCLE active state which was allowed to come to a thermal equilibrium. Once the cold plate pressure is returned to $P_{uniform}$ or other predetermined pressure, the loop is exited (2660) and waits for the control module loop (2530) to complete. Once both the control loop (2530) and cold plate pressure loop (2540) are complete, block (2670) changes the state to idle (1400) and the program is returned (2680) to the main check cold plate state loop (1225).

Returning to FIG. 11, the shutdown routine (1500) and off routine (1510) are not elaborated upon because these routines are well known in the prior art. It is assumed the shutdown and off status of the heat generating components are handled by their respective controllers (not shown). In most cases, when the shutdown routine (1500) is entered, all electronically actuated valves are in their respective closed position. If not, these valves are closed. The pressure regulating device, if electronically controlled, is closed. If main isolation valves connecting the cold plates and evaporators to the supply stream (80) or return stream (90) exist (not shown) these valves are closed. This completes the shutdown procedure, the program is returned back to the main check cold plate state loop (1225). The off routine (1510) continuously monitors for a change in state of the heat generating components. If the heat generating components become active, the cold plate state (1240) is changed accordingly and the program is returned back to the main check cold plate state loop (1225).

Referring to FIG. 26, is an exemplar summary of key operating parameters of demonstration system for a single pulse heat load. The system consists of a direct vapor compression system (20) and an individual cold plate assembly (30). An evaporator (60) was functionally included but not operated in the data shown. The direct vapor compression system (20) included a compressor (100), a condenser (120), three fans (130), a receiver (140), an accumulator (150), a liquid bypass valve (160), and a hot-gas bypass valve (170). The cold plate assembly (30) included temperature sensitive and non-temperature sensitive components for a 2.2 kW optical power fiber laser module. The system design parameters are summarized in Table 1. A total of 14 cold plate surface temperature measurements were collected. The isothermality, defined as the maximum range from the highest to lowest measured surface temperature at a single time, and overall temperature band, defined as the difference between overall maximum measured surface temperature at any time to overall minimum surface temperature at any time, is summarized in Table 2. These values demonstrate overall performance of the system in achieving the desired cold plate surface temperature control under a pulse heat load. The values shown in FIG. 26, define the key direct vapor compression system (20) pressures during operation. The condenser pressure and cold plate pressure are preset to achieve the desired condensing temperature and cold plate temperature, respectively. The fan (130) speed and bypass valve (160) and (170) positions set by the control method at each time step. The suction line pressure, average cold plate temperature, cold plate isothermality, and refrigerant flow through the cold plate are a result of the control methods actions.

TABLE 1

| Summary of Demonstration System Design Parameters | | |
|---|---|---|
| System Parameters | | — |
| Optical Power | 2.2 | kW |
| Heat Dissipation | 3.97 | kW |
| Target Isothermal Temperature | 24 | DEGC |
| Refrigerant Flow | 1.25 | LPM |
| Superheat Target | 3 | DEGC |
| Refrigerant | R134a | — |

TABLE 2

| Summary of Demonstration System Performance | | |
|---|---|---|
| Performance Summary | | |
| Average Isothermality | 2.3 | C |
| Overall Temperature Band (Max-Min) | 4.0 | C |

The above described device and control routine can operate independently or in combination.

The described examples in the disclosure have many advantages including maintaining uniform cold plate surface temperatures for pulsed heat loads over a wide range of operating conditions. The key advantage of at least one implementation of the control routine for a vapor compression system is that the control routine maintains stable supply and return process conditions to one or more cold plate assemblies while operating at near full capacity over a range of ambient conditions. The key advantage of at least one implementation of the control routine for the cold plate assembly is that the control method modulates the flow rate through and fluid pressure internal to the cold plate assembly based on heat load pulse pattern.

While we have shown and described several implementations in accordance with our invention, it should be understood that the same is susceptible to further changes and modifications without departing from the scope of our disclosure. Therefore, we do not want to be limited to the details shown and described herein but intend to cover all such changes and modifications as are encompassed by the scope of the appended claims.

What is claimed is:

1. A method of maintaining a uniform isothermal temperature distribution on at least one cold plate having highly transient thermal loads thereon by utilizing a vapor compression apparatus having a supply line and a return line connected to the cold plate and using a compressor to draw a vapor working fluid from the at least one cold plate in order to compress the vapor working fluid and supply a compressed higher-pressure refrigerant to a condenser and the condenser to condense the working fluid to a liquid that flows to the at least one cold plate via the supply line and evaporates in the at least one cold plate to remove the heat load supplied to the at least one cold plate from the highly transient thermal loads, and returning a lower-pressure fluid vapor to the inlet of the compressor via the return line, and a controller, wherein the controller is configured to execute the method comprising:

a. adjusting a bypass of fluid flow directly back to the compressor suction from the compressor discharge or adjusting the speed of the compressor to maintain a necessary compressor suction pressure responding to varying flow demands from the cold plate;

b. adjusting a bypass of fluid flow around the at least one cold plate to control the superheat at the compressor suction;

c. adjusting the flow of fluid through the at least one cold plate to maintain a desired superheat of fluid exiting the at least one cold plate to accommodate varying heat loads; and d. adjusting the opening of a cold plate outlet valve in the at least one cold plate exit flow path to maintain a desired saturation temperature in the at least one cold plate by adjusting pressure of the fluid in the exit flow path;

wherein adjusting the flow of fluid through the at least one cold plate with multiple parallel passages is to maintain balanced flow rate among the multiple parallel passages and also maintain the desired superheat of a fluid leaving the multiple parallel passages after being recombined into a single flow from the cold plate exit is through the adjustment of the superheat temperature by throttling of an expansion valve at the inlet to all the passages of a cold plate, where each passage has an additional flow restriction or orifice to create a flow condition wherein the refrigerant is a single phase fluid between the single expansion valve and the multiple parallel passages to ensure a near uniform refrigeration flow rate between each channel by means of the additional flow restriction or the orifice.

2. The method of claim 1, wherein the method of adjusting the temperature of the at least one cold plate is controlling the pressure between the cold plate outlet valve and the cold plate, wherein increasing the opening of the cold plate outlet valve at the discharge of the cold plate lowers the discharge pressure and lowers the saturation temperature and decreasing the opening of the cold plate outlet valve at the discharge of the cold plate increases the saturation temperature.

3. The method of claim 1, wherein maintaining the desired superheat of the fluid leaving the at least one cold plate is through the adjustment of superheat temperature by throttling of the expansion valve at the inlet to the one or more cold plates, wherein increasing the opening of the expansion valve reduces the superheat and reducing the opening of the expansion valve increases the superheat.

4. The method of claim 3, wherein the expansion valve is a thermal expansion valve or an electronic expansion valve and wherein maintaining the desired superheat of the fluid leaving the at least one cold plate is through the adjustment of the superheat temperature by throttling of the thermal expansion valve or the electronic expansion valve.

5. The method of claim 1, further comprising the step of: providing a thermal storage device in the refrigerant flow path, either before or after the condenser in the flow path, to increase short-term capacity of the system.

6. The method of claim 1, further comprising the step of: providing a liquid receiver in the refrigerant flow path, after the condenser and before the at least one cold plate in the flow path, to increase short-term capacity of the system.

7. The method of claim 1, further comprising the step of: providing a suction line accumulator in the refrigerant flow path, before the compressor in the flow path, to protect the compressor during rapid transients.

* * * * *